US008789721B2

(12) United States Patent
Oohori et al.

(10) Patent No.: US 8,789,721 B2
(45) Date of Patent: Jul. 29, 2014

(54) SQUARE CAN AND METHOD AND APPARATUS FOR DOUBLE SEAMING THE SAME

(75) Inventors: Kei Oohori, Yokohama (JP); Kiyotaka Yoshida, Yokohama (JP); Sunao Morishita, Yokohama (JP); Kanji Kuroda, Yokohama (JP); Norifumi Yasuda, Saitama (JP); Kazuo Ando, Saitama (JP); Hisashi Katoh, Saitama (JP)

(73) Assignee: Toyo Seikan Kaisha, Ltd., Tokyo (JP)

( * ) Notice: Subject to any disclaimer, the term of this patent is extended or adjusted under 35 U.S.C. 154(b) by 1143 days.

(21) Appl. No.: 11/914,646

(22) PCT Filed: May 16, 2006

(86) PCT No.: PCT/JP2006/309710

§ 371 (c)(1),
(2), (4) Date: Nov. 16, 2007

(87) PCT Pub. No.: WO2006/123637

PCT Pub. Date: Nov. 23, 2006

(65) Prior Publication Data

US 2009/0200321 A1 Aug. 13, 2009

(30) Foreign Application Priority Data

May 17, 2005 (JP) ..... 2005-144600
May 17, 2005 (JP) ..... 2005-144601

(51) Int. Cl.
*B65D 8/20* (2006.01)

(52) U.S. Cl.
USPC ..... 220/619; 220/623

(58) Field of Classification Search
USPC ..... 220/615, 619, 623
See application file for complete search history.

(56) References Cited

U.S. PATENT DOCUMENTS 782,142 A * 2/1905 Kenny ..... 220/619
2,455,737 A * 12/1948 Coyle ..... 413/6

(Continued)

FOREIGN PATENT DOCUMENTS

JP 63281721 A 11/1988

OTHER PUBLICATIONS

Translation of International Preliminary Report on Patentability mailed Nov. 29, 2007 of International Application No. PCT/JP2006/309710.

(Continued)

*Primary Examiner* — Stephen Castellano
(74) *Attorney, Agent, or Firm* — Westerman, Hattori, Daniels & Adrian, LLP

(57) ABSTRACT

A square can capable of securing high sealing performance even if a curvature radius of a seamed portion at a seamed corner portion is reduced, enabling a reduction in a countersink depth, reduced in size, having excellent sealing ability and storage efficiency and a method and an apparatus for double seaming the square can. A second seaming roll (55) is guided by a model cam for second seaming having a model cam surface for second seaming formed in such a shape that it is swelled from a model cam surface for first seaming outwards at a corner seamed portion (5). Accordingly, the seaming shape of the corner seamed portion (5) is formed in such a shape that the seaming width thereof at the center of the corner seamed portion is larger than the seaming width of a linear sealed portion (4) and is swelled outwards to absorb an increase in sheet thickness at the corner seamed portion. Also, a seaming wall (6) is formed in an obliquely inclined seamed shape so that the overlap of a cover hook (8) with a body hook (10) of a prescribed amount can be secured without allowing the cover hook (8) to fall from the body hook (10) so as to maintain excellent sealing ability.

7 Claims, 15 Drawing Sheets

(56) References Cited

U.S. PATENT DOCUMENTS

| | | | | | |
|---|---|---|---|---|---|
| 3,295,485 | A * | 1/1967 | Gedde | 413/7 |
| 3,586,204 | A * | 6/1971 | Roper | 220/200 |
| 3,774,560 | A * | 11/1973 | Hartz | 413/6 |
| 3,977,342 | A * | 8/1976 | Kawamata | 413/6 |
| 4,564,119 | A * | 1/1986 | Tsuge et al. | 220/270 |
| 4,875,597 | A * | 10/1989 | Saunders | 220/270 |
| 4,892,209 | A * | 1/1990 | Dorfman et al. | 215/277 |
| 5,595,322 | A * | 1/1997 | Kramer | 220/619 |
| 5,915,587 | A * | 6/1999 | Kramer | 220/619 |
| 7,278,548 | B2 * | 10/2007 | Rieck et al. | 220/521 |
| 7,370,774 | B2 * | 5/2008 | Watson et al. | 220/619 |
| 7,662,512 | B2 * | 2/2010 | Yasuda et al. | 429/175 |
| 2002/0158071 | A1 * | 10/2002 | Chasteen et al. | 220/269 |
| 2004/0074911 | A1 * | 4/2004 | Stodd | 220/619 |
| 2004/0238546 | A1 * | 12/2004 | Watson et al. | 220/619 |
| 2009/0200321 | A1 * | 8/2009 | Oohori et al. | 220/619 |

OTHER PUBLICATIONS

International Search Report of PCT/JP2006/309710, date of mailing Aug. 15, 2006.

* cited by examiner

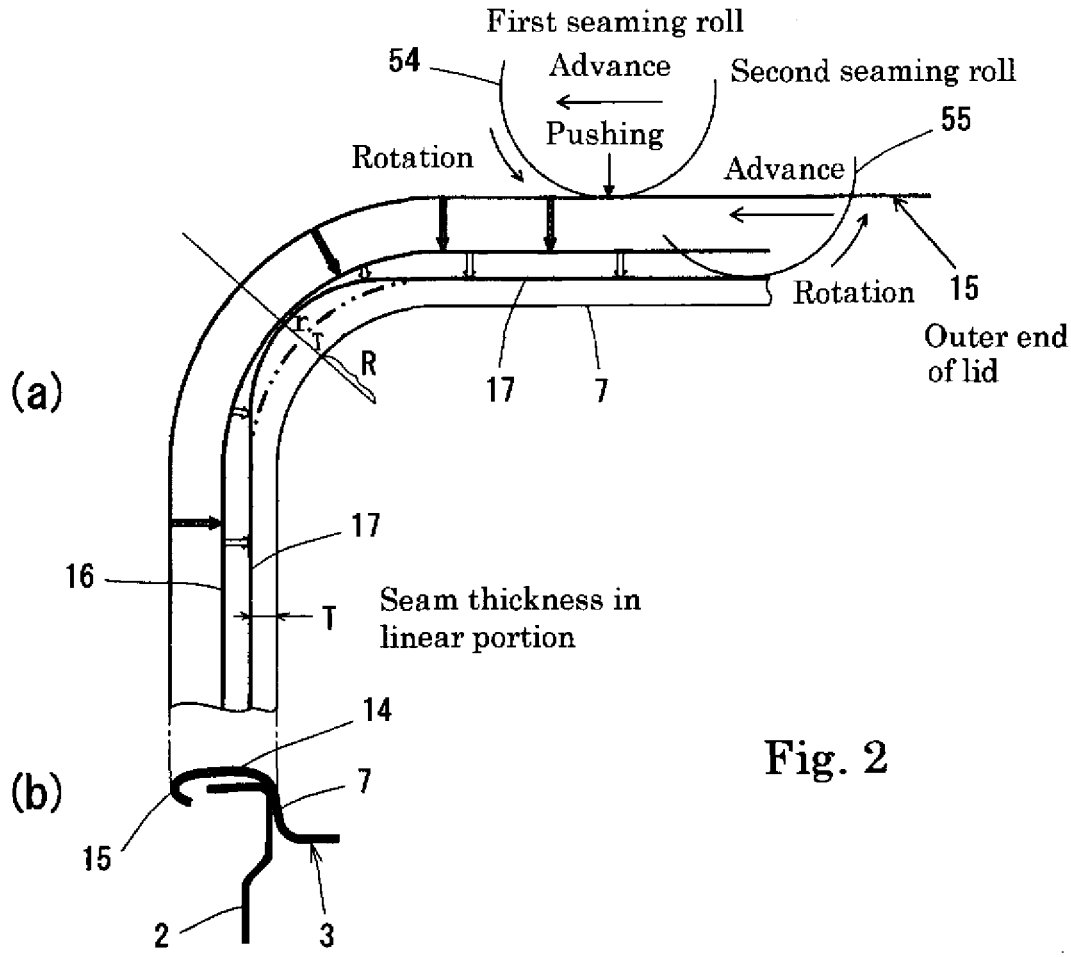
Fig. 2
Fig. 3
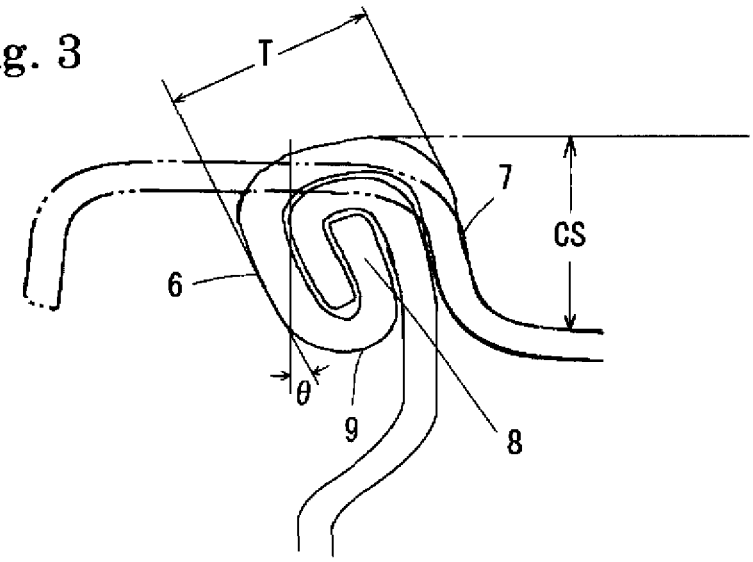

Fig. 7
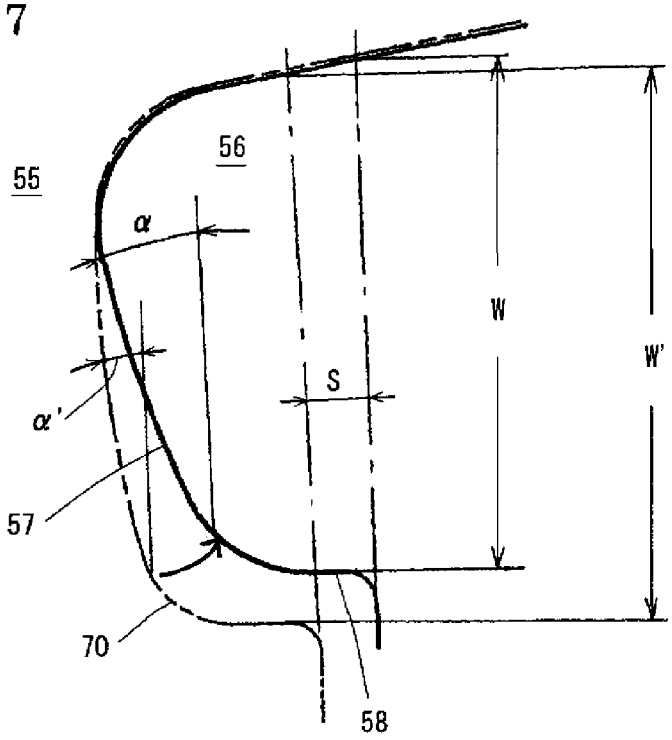
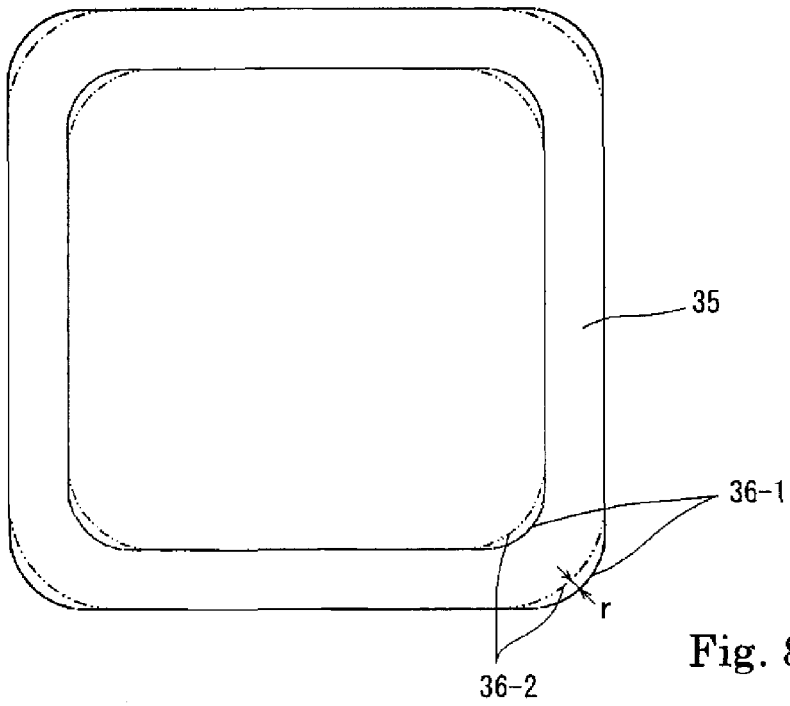
Fig. 8

(a)
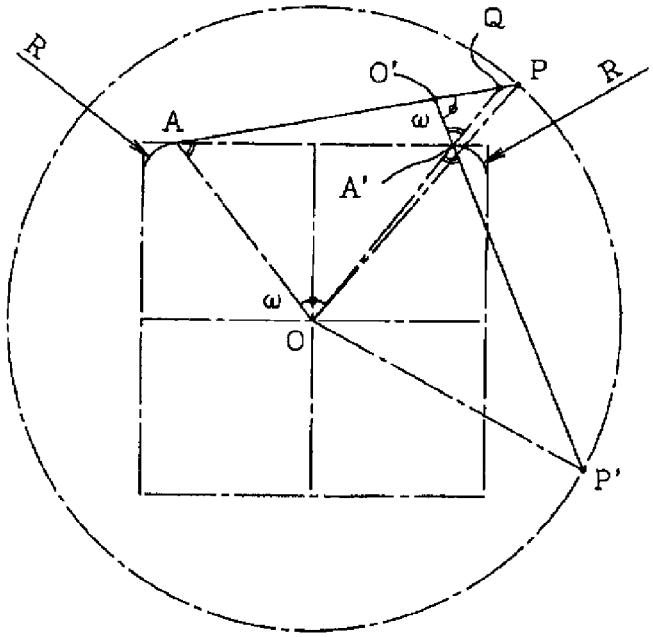
(b)
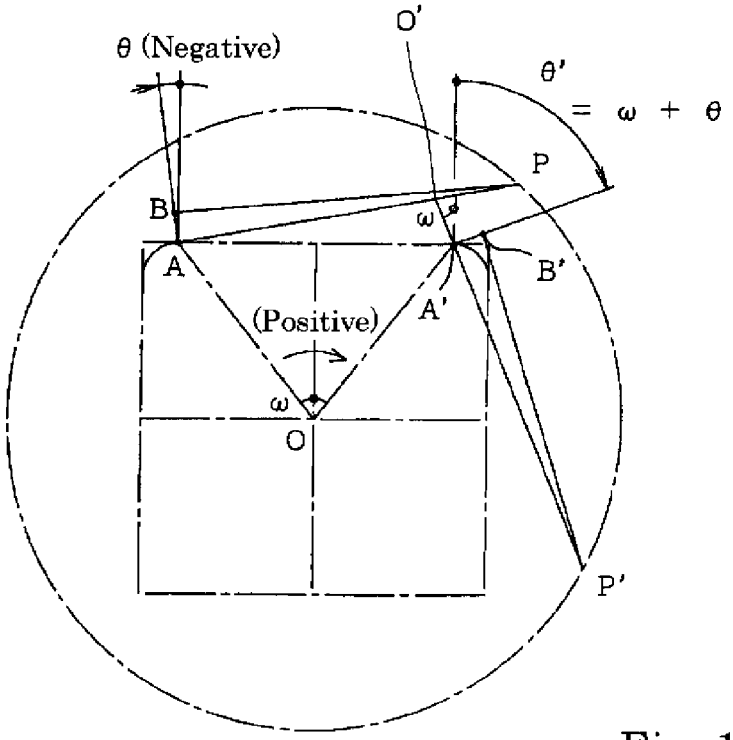
Fig. 11

Fig. 12
(a)
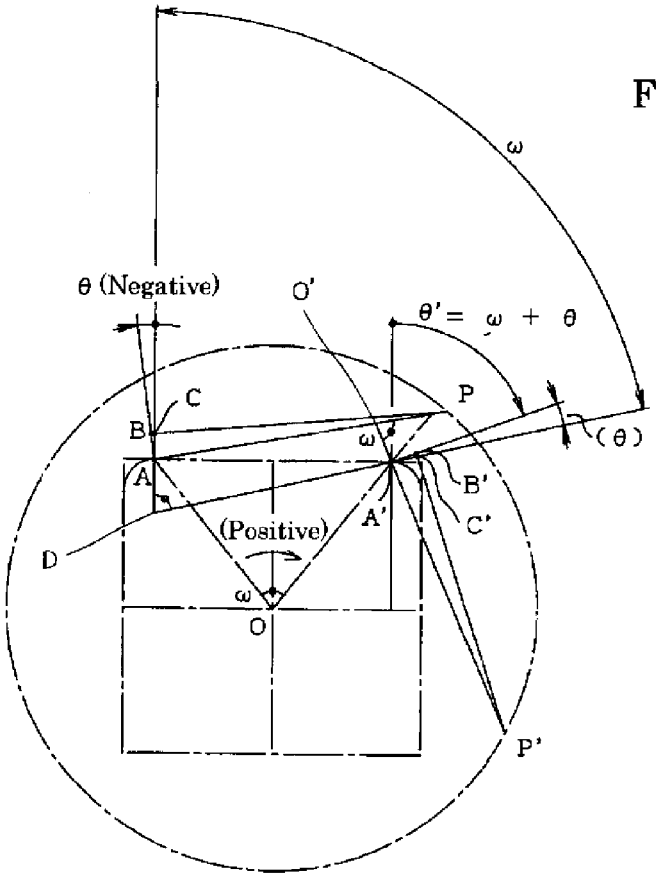
(b)
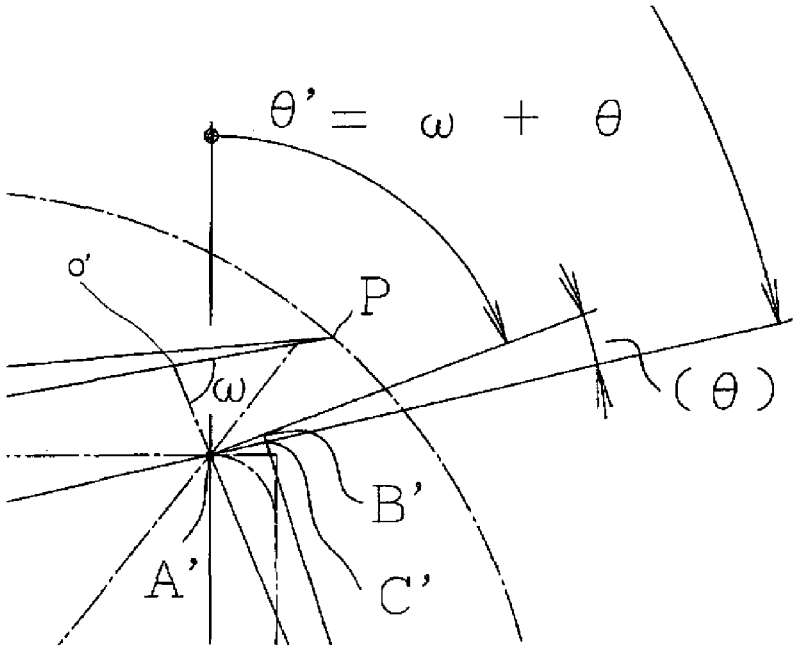

Fig. 17 Relationship between advancement of seaming process and change in Tc size Fig. 18
Example
(a)
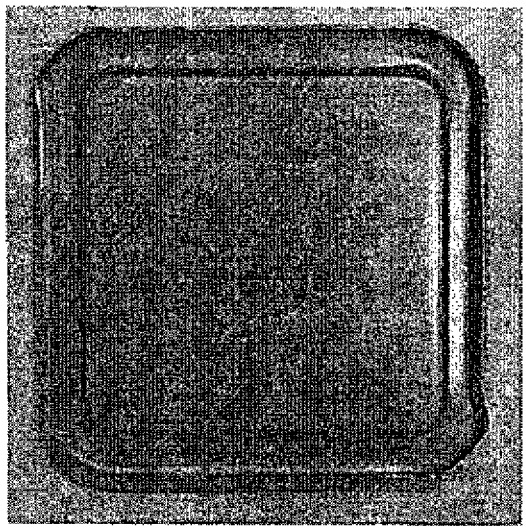
Comparative example
(b)
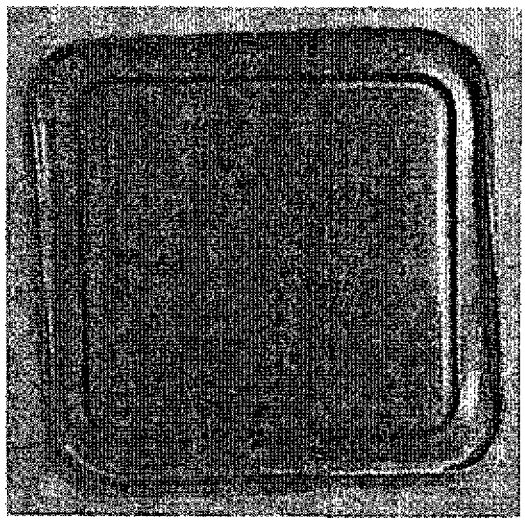

SQUARE CAN AND METHOD AND APPARATUS FOR DOUBLE SEAMING THE SAME

TECHNICAL FIELD

The present invention relates to a square can, and more particularly to a square can in which a curvature radius of a corner seamed portion can be decreased, while ensuring high sealing ability, and also to a method and apparatus for double seaming such a can.

BACKGROUND ART

When a square can is double seamed, because the can has a corner seamed portion and a linear portion, it is difficult to perform seaming by rotating the can, at variance with the case of seaming a round can, and seaming is generally performed by revolving a first seaming roll and a second seaming roll, while controlling the trajectories thereof with a model cam having formed therein a cam groove having a shape similar to that of the can, in a state where a can body and a lid are clamped and fixed by a seaming chuck and a lifter (see the patent document 1). In such seaming of a square can, flange portions of the can body and can end are subjected to bending in the linear portion, but in the corner seamed portion, shrinking processing (that is, drawing) is conducted together with bending processing because seaming is accompanied by diameter reduction of the flange. Therefore, in the corner seamed portion, the sheet thickness increases due to metal flow caused by shrinking, and the portion that is not absorbed by sheet thickness increase remains as wrinkles or the flange width increases. This phenomenon becomes more prominent as the drawing ratio of the corner seamed portion increases. In the case of seaming a round can, drawing is also performed and similar phenomenon is observed, but because the curvature radius of the seamed portion in the round can is large, the drawing ratio is small and good seaming can be performed practically without the occurrence of wrinkles or flange elongation. As a result, few problems are associated with degraded sealing ability. However, in the case of square cans, the curvature radius of the corner seamed portion is much less than the round can diameter. Therefore, the drawing ratio obviously increases, wrinkles or flange elongation easily occur in the corner seamed portion, sealing ability in this portion deteriorates, and the sealing ability is inferior to that of round cans. Examples of means for resolving such problems inherent to square cans are suggested in the patent documents 2 and 3, but a satisfactory solution for problems arising when a corner seamed portion with a small curvature radius is seamed is yet to be found.

For this reason, a square shape has been conventionally employed for large cans such as five-gallon cans with a comparatively large curvature radius of corner seamed portion, and small square cans have been used for storing the contents that does not require a comparatively high level of sealing, such as cakes which are non-liquid contents. Thus, generally, small square cans have not been used for applications requiring a high level of sealing, such as beverage cans. However, a specific feature of square cans is that no gaps appear between the cans when they are assembled and the accommodation efficiency thereof is much higher than that of round cans. With this feature in view, a demand has recently been created for small square cans for special applications with high sealing ability that can be filled with contents requiring high sealing ability. In order to increase further the accommodation efficiency, which is a specific feature of squire cans, it is necessary that practically no dead space appear when the cans are stacked in the longitudinal-lateral and up-down directions, and in order to satisfy this requirement it is necessary that the curvature radius of the corner seamed portion of the seamed portion be reduced to obtain a corner seamed portion that is very close to a right angle and that the lid seamed portion be reduced to a minimum. On the other hand, from the standpoint of increasing the contents filling efficiency related to the volume occupied by a can, a can shape is preferred in which the upper and lower panel portions of the can ends are positioned at a very small depth from the end surface of can body, that is, that the distance from the top portion of the can seamed portion to the deepest position corresponding to the inflection portion where transition is made to the lower inner wall of the seamed portion or panel surface of the can end (usually referred to as "countersink depth") be small. However, these requirements are diametrically opposite to those relating to the increase in sealing ability and can be damaging factors from the standpoint of sealing ability. For this reason, square cans that demonstrate a high level of sealing that enables them to be filled with liquid contents, have a small curvature radius of corner seamed portions, and also have a small countersink depth have not yet been obtained.

[Patent Document 1] Japanese Patent Application Laid-open No. 51-104469

[Patent Document 2] Japanese Patent Application Laid-open No. 58-58950

[Patent Document 3] Japanese Examined Patent Application No. 02-62094

DISCLOSURE OF THE INVENTION

Problem to be Solved by the Invention

The inventors have conducted the following seaming test to analyze more accurately the causes of the above-described problems encountered when double seaming is applied to a square can with a decreased curvature radius of corners.

In the test, as explained with the below-described comparative example, a seaming chuck 71 was used in which the engagement surface of a chuck wall 7 was formed to have a depth less than that in the conventional seaming chuck, as shown in FIG. 14, and in the double seaming process, a square can with a small curvature radius of a corner seamed portion was seamed using a second seaming roll 70 in which a formation surface 72 of a seaming wall had an almost vertical groove identical to that of the conventional second seaming roll. Corner seamed portions were cut after completion of first seaming and second seaming in this process, the cross sections were photographed under a scanning electron microscope, and the cross-sectional shape was observed. The results obtained demonstrated the following phenomenon. Thus, a large number of wrinkles occurred in the corner seamed portion, in particular in the distal end portion of a cover hook 8, during first seaming, this portion sank, and the distal end of the cover hook collided with the distal end of a body hook 10, as shown in FIG. 15(*a*). Once second seaming has been conducted in such state, as shown in figure (*b*), the overlap of the cover hook 8 and body hook 10 that demonstrates a function important for ensuring sealing ability in the double seam could not be ensured, and leak could occur from this portion. Further, even when the overlap of the cover hook and body hook is obtained in first seaming, because sheet thickness increases in the corner seamed portion, the desired seam shape can hardly be obtained, and if push-in processing is performed with the second seaming roll in second seaming to obtain a seam thickness (usually, referred to as "T size")

that is equal to that of the linear seamed portion, the seaming is performed in a state in which the cover hook 8 is detached from the body hook 10, as shown in FIG. 13(*b*), causing sealing defects. Further, when a can with a small countersink depth is to be obtained, in double seaming of various shapes not limited to that of square can, the depth of chuck wall has to be decreased accordingly, the backup quantity at the seaming chuck during seaming decreases, good seam shape cannot be obtained during second seaming, and the countersink depth cannot be reduced to below a fixed level.

On the other hand, in an apparatus for seaming a square can by the conventional gradual seaming method, the occurrence of wrinkles in the square can with a reduced curvature radius of corner seamed portions was found to be caused not only by the above-described second seaming process, but also by changes in the seam shape of the linear portion in the first seaming process.

FIGS. 16(*a*) to (*c*) show schematically the seaming head portion viewed from below, these figures facilitating the understanding of displacement of a first seaming lever 81 having a first seaming roll 83 mounted thereon and a model cam lever 40 having a model cam follower 88 mounted thereon during first seaming in the conventional apparatus for seaming a square can.

In the configuration shown in the figures, the first seaming roll 83 is pushed in through the predetermined distance by the seaming cam and rotated in this state through a predetermined angle, and these operations are repeated multiple times thereby producing the final seamed shape (alternatively, the first seaming roll is steadily pushed in and the seaming width Tc is gradually decreased), but when the model cam follower 88 passes the linear portion, even if the same push-in amount is maintained by the seaming cam, the first seaming roll gradually escapes outward in the linear portion, as shown in FIGS. 16(*b*) and (*c*), and the same seaming width cannot be always obtained in the intermediate stage. Thus, when the linear portion of a model cam 90 of a substantially square shape is steered, while being followed by the model cam follower 88, in transition from a circular motion, the seaming lever position changes monotonously according to the monotonous inclination change of the model cam lever 40. Following this monotonous change, a segment connecting the model cam follower center and the seaming roll center crosses the model cam lever at an angle close to a right angle. The resultant phenomenon is that the inclination angle $\theta_2$ also changes monotonously, and the distance between the seaming chuck 71 and the first seaming roll 83 increases with the decrease in the absolute value of the inclination angle $\theta_2$ of the segment between the rolls. As a result, the end part of the linear portion on one side close to each corner portion is pushed inward, the seaming width (T size) of each side in the final seam shape changes monotonously, as shown in FIG. 18(*b*), and uniform seam dimensions cannot be obtained.

The resultant phenomenon is that the intermediate seaming width close to the inlet portion of the corner portion is different from that close to the outlet portion. On the other hand, in the corner portion, the seaming roll also moves along a circular arc, but because it rotates to make an abrupt transition from a shallow state to a deep state in order to match the push-in amount of the subsequent linear portion, the amount of processing in the corner portions increases due to the aforementioned phenomenon, the unbalance of molding amount occurs, and this unbalance together with shrinking processing of the corner portion cause non-uniform seaming and the occurrence of a large number of wrinkles. In particular, when a square can with a small corner R is seamed, drawing of the outlet of the corner R portion becomes too deep, causing a large number of seaming wrinkles.

This effect can be explained as follows. When the model cam lever 40, which ensures transition from circular motion to substantially angular motion, steers the linear portion of the model cam 90 of a substantially square shape, while it is followed by the model cam follower 88, the first seaming lever 81 changes its inclination monotonously according to a monotonous change in the inclination of the model cam lever 40, and following this change, the segment ($O_1$-$O_2$) connecting the model cam follower center $O_1$ and the seaming roll center $O_2$ crosses the model cam lever at an angle close to a right angle when the opening angle of the seaming lever is not too large. Therefore, the inclination angle $\theta_2$ also changes monotonously, and the distance between the seaming chuck 71 and the first seaming roll 83 increases with the decrease in the absolute value of the inclination angle $\theta_2$ of the segment between the rolls. As a result, at the initial stage of seaming, the trajectory of the first seaming roll 83 deviates from the similar trajectory of the model cam 90 and sometimes becomes a trajectory of a shape that is obtained by rotating the similar trajectory of the model cam 90 through a certain angle.

In the case where the above-described phenomenon occurs at the initial stage of processing, if the processing advances and the opening angle $\theta_1$ between the model cam lever 40 and the first seaming lever 81 decreases, the processing amount in a portion where the distance between the first seaming roll 83 and the seaming chuck 71 is large at the initial stage of processing becomes larger than that in the portion where the distance is small. Therefore, the molding amount becomes very large and seaming wrinkles are easily induced. In particular, when the curvature radius of the corner portion is small, the drawing ratio becomes larger with respect to the flange width, thereby causing the appearance of significant seaming wrinkles. To overcome this drawback, it can be suggested to reduce the decrease quantity $\delta\theta_1$ of the opening angle $\theta_1$ of the seaming lever and model cam lever per one rotation of a seaming head rotary plate 27 in the portion where the distance between the first seaming roll 83 and the seaming chuck 71 is large at the initial stage of processing and to decrease the processing amount, but the problem encountered in such case is that the molding rate decreases and productivity drops.

When the linear seamed portion is seamed, even if the same push-in amount is maintained by the seaming cam, the seaming roll gradually escapes outward in the linear portion, and the same seaming width cannot be always obtained in the intermediate stage. Thus, when the linear portion of the model cam of a substantially square shape is steered, while being followed by the model cam follower, in transition from a circular motion, the seaming lever position changes monotonously according to the monotonous inclination change of the model cam lever. Following this monotonous change, a segment connecting the model cam follower center and the seaming roll center crosses the model cam lever at an angle close to a right angle. The resultant phenomenon is that the inclination angle $\theta_2$ also changes monotonously, and the distance between the seaming chuck and the first seaming roll increases with the decrease in the absolute value of the inclination angle $\theta_2$ of the segment between the rolls. As a result, the end part of the linear portion on one side close to each corner portion is pushed inward, the seaming width (T size) of each side in the final seam shape changes monotonously, and uniform seam dimensions cannot be obtained.

Accordingly, it is an object of the present invention to provide a square can that makes it possible to resolve the above-described problems and satisfy the aforementioned mutually contradicting requirements at the same time, ensure high sealing ability even with a small curvature radius of the corner seamed portion, and decrease the countersink depth, and also has a small size, high accommodation efficiency, and a seamed portion with high sealing ability, and also to provide a method and apparatus for seaming a square can that make it possible to obtain such a square can.

Means for Solving Problem

The square can in accordance with the present invention that resolves the above-described problems is a square can having a corner seamed portion and a linear seamed portion where a can body is double seamed with a can end, wherein a seam shape of the corner seamed portion is formed such that a seaming width in a center of the corner seamed portion is larger than a seaming width of the linear seamed portion and the seam shape swells outwardly.

Since the seaming width of the corner seamed portion is larger than the seaming width of the linear seamed portion, the increase in sheet thickness of the can occurring during corner seaming can be absorbed. As a result, a double-seamed can with high sealing ability can be obtained even with a square can that has a corner seamed portion with a small curvature radius where a cover hook is pushed out from a body hook.

Another feature of the square can in accordance with the present invention is that a seaming wall portion of the linear seamed portion and corner seamed portion has an obliquely inclined seam shape. With such seam shape, the cover hook of the can is not detached from the body hook of the can, a predetermined overlapping thereof can be ensured, and good sealing can be maintained. Further, seaming of a can with a small countersink depth is made possible. An inclination angle of the seaming wall portion is preferably 15° to 21°. Where the inclination angle is 15° or less, the push-in effect of the cover hook during second seaming is small and the cover hook can be easily detached. Where the inclination angle is 21° or more, conversely, the distal end of the cover hook projects to the can body and the correct double-seamed shape cannot be obtained.

Yet another feature of the square can in accordance with the present invention is that the countersink depth of the can end can be formed to be 2 to 4 mm, a square can with a depth from an apex portion of the can body to the can end that is less than that in the conventional cans can be obtained, and a can with a high volume efficiency can be obtained. Further, by employing the above-described seamed shape, even a square can with a curvature radius of the corner seamed portion of 10 mm or less can be seamed to retain high sealing ability. A degree of sealing of the can is preferably such that no leak occurs under a pressure of 0.3 MPa inside the can. The square can be applied not only as a can for canned food, but also as a battery container that requires high sealing ability, and a container for a capacitor.

With a method for double seaming a square can in accordance with the present invention that serves to obtain the aforementioned square can, a model cam that guides a first seaming roll and a second seaming roll along the seamed portions of the can is formed on cam surfaces where a model cam surface for first seaming is different from a model cam surface for second seaming, and double seaming is performed so that a seaming width of the corner seamed portion is larger than a seaming width of the linear seamed portion, thereby absorbing an increase in sheet thickness in the corner seamed portion, by guiding the second seaming roll with the model cam for second seaming that is formed in a shape such that the model cam surface for second seaming is caused to bulge outwardly with respect to the model cam surface for first seaming in the corner seamed portion.

Yet another feature of the method for double seaming a square can in accordance with the present invention is that a seaming wall formation surface of a groove of the second seaming roll is formed obliquely, a cover hook is caused to overlap a body hook by a predetermined width by pushing in a cover hook radius portion obliquely upward with the second seaming roll during second seaming, and a seam shape is obtained in which the seaming wall is inclined obliquely at an angle of 15° to 21° with respect to a vertical line. Still another feature is that seaming is performed in a state in which a zone from a chuck wall of the can end to a seaming panel radius portion is backed up with a seaming chuck.

Further, in the method for double seaming a square can in accordance with the present invention in which gradual molding is performed such that molding is completed by finally causing a seaming roll to follow the edge of a substantially square can with the model cam, it is preferred that when a model cam follower is steered along a linear portion of the model cam at the initial stage of seaming, fluctuations of a push-in amount of a seaming roll during processing of the linear portion are maintained within a substantially constant range by changing an angle formed by a segment connecting a center of the model cam follower and a center of the seaming roll and a perpendicular to the linear portion of the model cam that steers the model cam follower from positive to negative or from negative to positive during seaming of the linear portion. As a result, spread in the seaming width of the seamed portion of the square can, more particularly the difference in distance from the seaming chuck to the seaming roll between the two ends of the linear seamed portion is reduced. Therefore, abrupt variation in the processing amount in the corner portion is eliminated, occurrence of wrinkles is inhibited even in the corner portions with high curvature, and good seaming can be performed.

Further, in the apparatus for double seaming a square can in accordance with the present invention, a model cam that guides a first seaming roll and a second seaming roll along a seamed portion of the can is formed on cam surfaces where a model cam surface for first seaming is different from a model cam surface for second seaming, and the model cam surface for second seaming is formed to bulge outwardly with respect to the model cam surface for first seaming in a corner seamed portion.

The bulging is preferably such that an amount of outward protrusion in a central portion of a corner of the model cam surface for second seaming is 0.3 mm to 0.8 mm with respect to a central portion of a corner of the model cam surface for first seaming. Where the amount of outward protrusion is 0.2 mm or less, the effect of absorbing the increase in sheet thickness during corner seaming is small, the occurrence of wrinkles in a can with a small curvature radius increases, and sealing ability cannot be obtained. Where the amount of outward protrusion is 1 mm or more, the bulging amount of seaming wall in the corner seamed portion increases, smooth connection of the linear seamed portion with the seaming wall cannot be obtained, and there is a risk of sealing being degraded in this portion. In order to attain the seaming method in which sufficient overlapping of cover hook and body hook can be obtained, it is preferred that in the second seaming roll, a seaming wall formation surface of a groove be inclined at an angle of 15° to 21° with respect to a vertical line. Further, where the second seaming roll has a protruding chin portion and a groove width within a range of 2.7 mm to 3.5 mm, a double-seamed portion of a small height can be obtained.

Forming the seaming chuck of such a shape that can back up a zone from a chuck wall of the can end to a seaming panel radius portion during seaming is effective for seaming in which the cover hook radius is pushed up obliquely and also for enabling the efficient backup and forming a small seamed portion. Further, by forming a small engagement depth of the seaming chuck to the seamed portion of 2 to 4 mm, it is possible to obtain a double-seamed can with a small countersink depth.

Further, a configuration is preferred such that when a model cam follower is steered along a linear portion of the model cam for first seaming when the first seaming is started, an angle formed by a segment connecting a center of the model cam follower and a center of the first seaming roll and the linear portion of the model cam that steers the model cam follower changes from positive to negative or from negative to positive.

Effects of the Invention

As described hereinabove, in accordance with the present invention, it is possible to obtain a square can with a seamed portion having a small curvature radius of the corner seamed portion and a small countersink depth of the can end, without decreasing sealing ability. Therefore, in the square can in accordance with the present invention, accommodation efficiency that is a strong feature of square cans can be further increased, high sealing ability that could not be attained in the conventional square cans can be ensured, the square can may be used for sealing and storing the contents that require high sealing ability, and the application range of square cans is expanded.

Further, with the method and apparatus for double seaming a square can in accordance with the present invention, a cam groove shape of a model cam for second seaming is formed such as to bulge outward with respect to a cam groove shape of a model cam for first seaming in a corner seamed portion and a second seaming roll is set to escape through a fixed width outward in the corner seamed portion. Therefore, the increase in sheet thickness caused by shrinkage during second seaming can be effectively absorbed, occurrence of wrinkles can be inhibited, and good double seaming can be performed even in corner seamed portions with a small curvature radius. Furthermore, the second seaming roll pushes a cover hook radius portion obliquely upward during second seaming and performs seaming, while supporting the cover hook. As a result, sufficient overlapping of the cover hook and body hook can be ensured and sealing ability can be increased. In addition, by performing second seaming, while pushing the cover hook radius portion obliquely upward, as described hereinabove, sufficient backup by a seaming chuck can be ensured and good double seaming can be performed even if the depth of chuck wall is small and the amount of backup at the seaming chuck is small. Therefore, a shallow seaming chuck can be formed and a square can that has a small countersink depth of can end, high volume efficiency, and excellent sealing ability can be obtained.

Furthermore, seaming can be performed such that fluctuations of push-in amount of the first seaming roll during processing of a linear seamed portion are maintained within a substantially constant range, and spread in the seaming width of the linear portion of the square can, more particularly the difference in distance from the seaming chuck to the seaming roll between the two ends of the linear seamed portion is reduced. Therefore, abrupt variation in the processing amount in the corner portion is eliminated, occurrence of wrinkles is inhibited even in the corner portions with high curvature, and good seaming can be performed.

BRIEF DESCRIPTION OF THE DRAWINGS

FIG. 2 is an explanatory drawing illustrating schematically how the outer end of a lid changes during processing in first seaming and second seaming of a corner seamed portion.

FIG. 3 is an enlarged cross-sectional view of the corner seamed portion after second seaming.

FIG. 7 is a schematic cross-sectional view illustrating main features of the second seaming roll of an embodiment.

FIG. 8 is a plan view of a cam groove of a model cam for second seaming of an embodiment.

FIG. 11 is an explanatory drawing illustrating the variation of an angle of a line connecting the central portion of a model cam follower and the center of a seaming roll when the linear portion is seamed by modeling the apparatus shown in FIG. 1 as illustrated by FIG. 5.

FIG. 12 is an explanatory drawing illustrating the variation of an angle of a line connecting the central portion of a model cam follower and the center of a seaming roll at a stage following that shown in FIG. 5.

FIG. 18 is a plane photocopy of a square can in a first seaming process (after a seaming roll has passed one time by the linear portion on the right side) in an embodiment and a comparative example.

EXPLANATIONS OF LETTERS AND NUMERALS

1 SQUARE CAN
2 CAN BODY

3 CAN END
4 LINEAR SEAMED PORTION
5 CORNER SEAMED PORTION
6 SEAMING WALL
7 CHUCK WALL
8 COVER HOOK
9 COVER HOOK RADIUS PORTION
10 BODY HOOK
12 SEAMING PANEL RADIUS PORTION
14 CAN END CURL PORTION
15 OUTER END OF CURL PORTION
20 APPARATUS FOR DOUBLE SEAMING A SQUARE CAN
21 UPPER MAIN BODY OF SEAMING APPARATUS
22 SEAMING HEAD UNIT
23 LIFTER UNIT
24 FIXED SHAFT
26 SEAMING HEAD ROTARY SHAFT
27 SEAMING HEAD ROTARY PLATE
28 SEAMING CAM SHAFT
29 SEAMING CAM
30 DRIVE PULLEY
31 DRIVE SHAFT
33 MODEL CAM FOLLOWER
34 CENTRAL TRACK OF MODEL CAM FOLLOWER
35 MODEL CAM GROOVE
36-1 SIDE WALL OF MODEL CAM GROOVE FOR SECOND SEAMING
36-2 SIDE WALL OF MODEL CAM GROOVE FOR FIRST SEAMING
40 MODEL CAM LEVER FOR FIRST SEAMING
41 MODEL CAM LEVER FOR SECOND SEAMING
44 ECCENTRIC PIN
45 SEAMING LEVER
46 LINK BOLT
47 LINK LEVER
48 ROTARY SHAFT
50 SEAMING CAM LEVER
51 SEAMING CAM FOLLOWER
54 FIRST SEAMING ROLL
55 SECOND SEAMING ROLL
57 SEAMING WALL FORMATION SURFACE
60, 71 SEAMING CHUCK
81 SEAMING LEVER FOR FIRST SEAMING

BEST MODE FOR CARRYING OUT THE INVENTION

Embodiments of the present invention will be described below with reference to the appended drawings.

Figure 1:
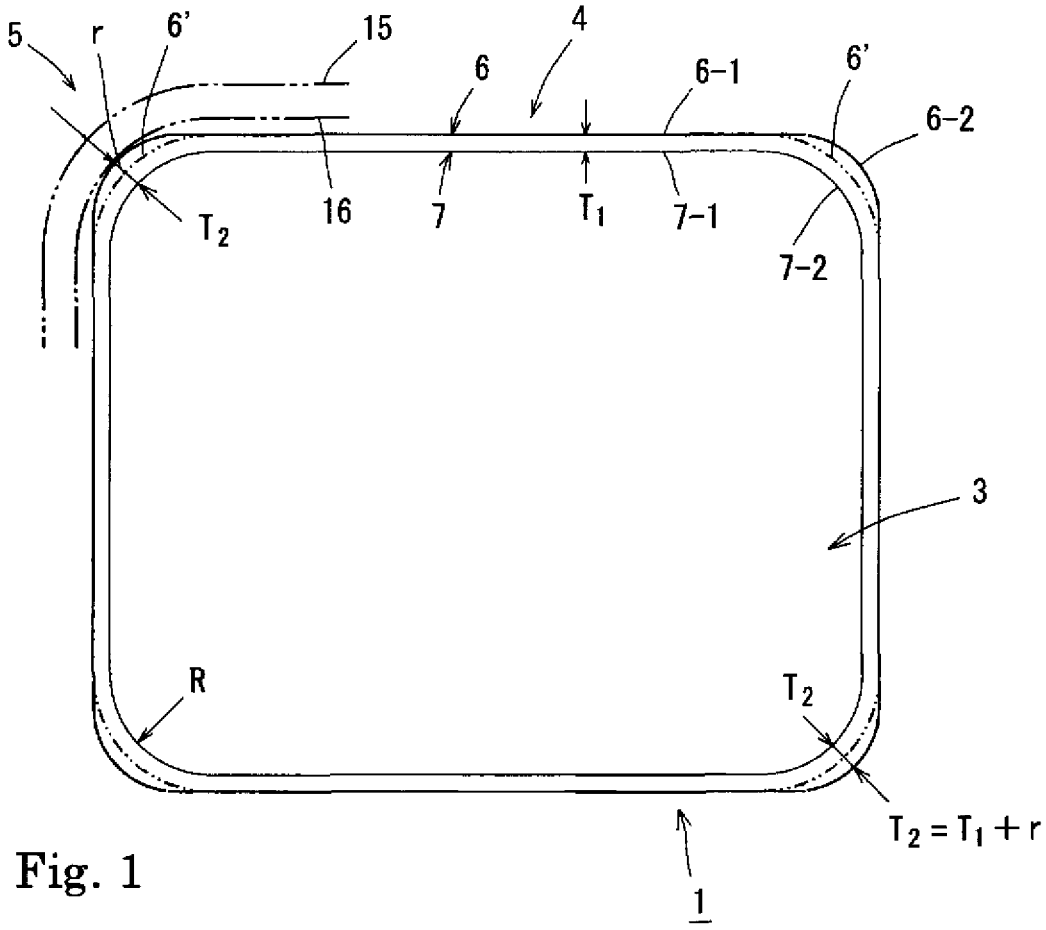
FIG. 1 is a plan view of a seamed portion of a square can in accordance with the present invention.

FIGS. 1 to 3 show a square can 1 of an embodiment of the present invention in which a can end 3 is double seamed to the upper and lower ends of a can body 2 that has a substantially square cross section. The can of the present embodiment is a so-called three-piece can, but it may also be a two-piece can in which a can end is seamed with an opening of an open-end can body formed by drawing.

The aim of the present invention is to provide for a high accommodation ratio and a high capacity ratio by bending a corner seamed portion of a four-corner can with a large curvature such as to obtain an angle as close to a right angle as possible, while preventing the occurrence of wrinkles in the corner seamed portion or detachment of a cover hook and ensuring high sealing ability. In the present embodiment, the object is to obtain a corner seamed portion with a very small (about 5 mm) curvature radius of a seaming chuck wall of the corner seamed portion prior to seaming of the can end. For this reason, with double seaming in the corner seamed portion, the drawing ratio increases, wrinkles and extension of body hook occur more often, and high sealing ability is difficult to ensure. In order to resolve this problem, in accordance with the present invention, as shown in FIG. 1, the final seam shape is formed such that a seaming width $T_2$ in the central part of a corner seamed portion 5 is larger than a seaming width $T_1$ of a linear seamed portion by a value corresponding to the increase in sheet thickness and the seam shape swells outward. The amount of sheet thickness increase during drawing is controlled by the sheet material thickness of the can end and the length of a flange serving as a seamed portion, that is, by the quantity of metal in the flame, and the smaller is the metal quantity, the larger is the amount of sheet thickness increase. In the embodiment shown in FIG. 1, the seaming width $T_2$ in the central part of the corner seamed portion is formed to be larger than the seaming width $T_1$ of the linear seamed portion by a value within a range of about 0.4 to 1 mm correspondingly to the sheet thickness of the can end, value of corner R (equal to or less than R10), and flange length. By performing such forming, the increase in sheet thickness in the corner seamed portion can be effectively absorbed, and protrusion and detachment of the cover hook caused by the increase in sheet thickness in the flange portion can be inhibited.

The seaming width T in double seaming is shown in a plan view in FIGS. 1 and 2, but as shown more accurately in FIG. 3, this width is the distance between a seaming wall 6 and a chuck wall 7 of the can end. In the case of a usual square can, as shown in FIG. 1, a seaming wall 6-2 and a chuck wall 7-2 of the corner seamed portion 5 are formed as concentric circular arcs, and a seaming wall 6-1 and a chuck wall 7-1 of the linear seamed portion are tangentially connected to the circular arcs. Therefore, seaming is performed such that the linear portions and corner seamed portions have the same width. Therefore, in this case, the seaming wall of the corner seamed portion is represented by a virtual line 6', and the circular arc radius thereof is represented by a chuck wall circular arc radius $R+T_1$. In the present embodiment, the width $T_2$ of corner seamed portion is formed such that the seaming wall 6-1 of the linear seamed portion comes into contact with a circular arc of a radius less than a curvature radius of the chuck wall passing through a point in which the seaming wall 6-1 is offset by a distance r from the point with a radius $R+T_1$ from the central point of a circular arc of the chuck wall along the central line of the corner seamed portion (45° line). As a result, as shown in the figure, the corner seamed portion has a shape such that the seaming wall in the central part thereof swells outward with respect to the conventional configuration. Further, the shape of the seaming wall of the corner seamed portion is not limited to the above-mentioned shape; thus, another possible shape is shifted outwardly by a distance r from the center of the seaming wall along the central line of the corner to describe a concentric circle with a radius $R+T_1$ and is smoothly connected at both end portions thereof to the seaming wall 6-1 of the linear seamed portion 4.

In FIG. 2, (a) is an explanatory drawing illustrating how seaming is advanced to obtain the seamed portion, and (b) shows the corresponding shape of a can end curl portion 14 before seaming is started.

In the figure, the reference numeral 7 stands for the chuck wall of the can end and is identical to a seaming chuck outline; 15 is an outer end of the curl portion of the can end before seaming is started. The seaming is performed in a conventional matter by placing the can end 3 on a can body opening, clamping and fixing by a lifter and a seaming chuck, revolving along the outer circumferential portion of the can, while guiding a first seaming roll 54 and a second seaming roll 55 by a model cam in the below-described manner, and pushing in the seaming wall 6 of the can end with the first seaming roll 54 and second seaming roll 55, while controlling the push-in amount with a seaming cam. In this process, first seaming is started by bringing the first seaming roll 54 into contact with the outer end 15 of the curl portion of the can end, the outer end 15 of the curl portion of the can end is pushed to a position shown by a line 16, thereby completing the first seaming process, then the second seaming process performed with the second seaming roll 55 is started from this position, and seaming wall 6 is pushed in from the line 16 to a position shown by a line 17, thereby completing the second molding process. Thus, the position of the line 17 is that of a seaming wall after the seaming has been completed, and the distance between the line 17 and the chuck wall is the seaming width. In the figure, black arrows represent the amount of processing (push-in amount) performed by the first seaming roll 54, and white arrows represent the amount of processing (push-in amount) performed by the second seaming roll. As shown in the figure, the push-in amount produced by the first seaming roll is identical in the linear seamed portion and corner seamed portion, but in the second seaming process performed by the second seaming roll 55, the amount of processing in the linear seamed portion 4 is different from the amount in the corner seamed portion 5. Thus, the push-in amount in the central part of the corner seamed portion is decreased by width r. As a result, in the central part of the corner seamed portion, the seaming width is enlarged by width r with respect to the seaming width obtained in seaming of the corner seamed portion that should be formed in the case where the push-in amount is the same as in the linear seamed portion shown by a virtual line, and the metal corresponding to the increase in sheet thickness caused by drawing is effectively absorbed to the degree corresponding to this extra width.

Further, the seamed portion of the present embodiment is formed such that the countersink depth, which is a depth from the top of the seamed portion of the can end to the deepest portion of the chuck wall (in the present embodiment, it is substantially the same plane as the lid panel plane), is decreased with respect to that in the conventional configuration, and the internal volume ratio of the can is increased. As a result, wrinkles occur in the corner seamed portion, the backup surface area of the seaming chuck relating to a push-in processing of the seaming roll during seaming is decreased, overlapping of the cover hook and body hook that is of utmost importance in terms of ensuring sealing ability of double seaming is difficult to ensure, and the cover hook 8 can be easily detached in the corner seamed portion 5. Accordingly, in the present embodiment, in order to prevent these drawbacks, the seaming wall 6 is inclined, as shown in FIG. 3, by an angle θ with respect to a central axis so that a seamed lower end portion 9 (usually, referred to as "cover hook radius") is positioned on the inward side of the can with respect to the seaming shape of the usual can. This inclination angle θ of the seaming wall 6 is preferably within a range of 15° to 21°. Where the angle is 15° or less, the cover hook is detached and a sufficient overlap amount of the cover hook 8 and body hook 10 cannot be ensured, and where the angle is 21° or more, the seamed portion is too oblique, second seaming is difficult, and good seam shape cannot be obtained. Further, where the seaming wall 6 is formed with such an inclination, the overlap amount of the cover hook and body hook can be easily ensured even when the flange width of the can end is small. Therefore, small seaming is possible. As a result, metal can be saved and material cost of the can may be reduced. Further, in order to obtain a high volume ratio, the square can of the present embodiment is formed to have a countersink depth as small as about 2 mm to 4 mm.

Figure 5:
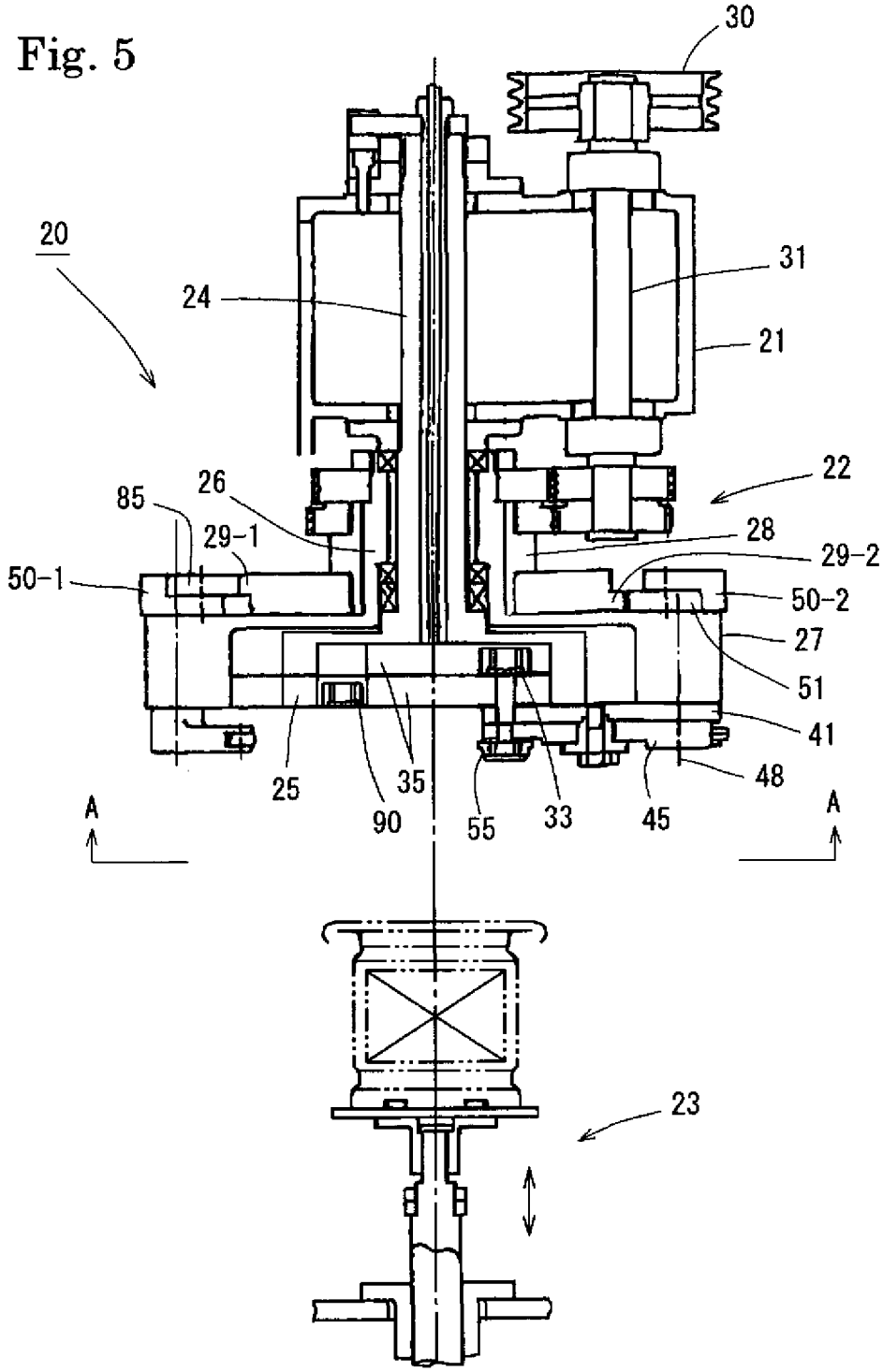
FIG. 5 is a cross-sectional view illustrating main features of an apparatus for double seaming a square can of the present embodiment.

A seaming apparatus and a seaming method for the square can with such seam shape will be described below. FIG. 5 is a schematic vertical sectional view of main components of a double seaming apparatus in accordance with the present invention.

In a conventional apparatus for double seaming a square can, both the first seaming roll and the second seaming roll are moved by the same model cam. Therefore, first seaming and second seaming are performed continuously in the same apparatus. In accordance with the present invention, two model cams are used that have different tracks for guiding the first seaming roll and second seaming roll. Therefore, a square can double seaming apparatus for first seaming and a square can double seaming apparatus for second seaming are configured separately. However, it is not always necessary to use a configuration in which separate apparatus are provided for first seaming and second seaming. Thus, a single apparatus can be employed by providing two model cams, one for a first seaming roll and another for a second seaming roll, in one apparatus. FIG. 5 shows an apparatus in which, in order to facilitate understanding, the first seaming roll is removed and only second seaming is performed in a seaming apparatus configured to perform first seaming and second seaming in one apparatus.

An apparatus for double seaming a square can 20 of the present embodiment comprises a seaming head unit 22 supported on an upper main body 21 of seaming apparatus and a lifter unit 23 that can move in the vertical direction along the same central axis with respect to the seaming head unit. In the seaming head unit 22, a fixed shaft 24 is fixed to the upper main body 21 of seaming apparatus, a model cam 25 is fixed to the distal end portion of the fixed shaft, and a seaming chuck (not shown in FIG. 5) is fixed to the central portion at the lower end of the model cam. Further, a cylindrical seaming head rotary shaft 26 is rotatably supported coaxially on the fixed shaft 24, and a disk-shaped seaming head rotary plate 27 is fixed to the lower end of the seaming head shaft. Further, a sleeve-like seaming cam shaft 28 is fitted onto the outer circumferential portion of the seaming head rotary shaft 26, and a seaming cam 29 is formed at the outer circumferential surface of the seaming cam shaft 28. As for the seaming cam, when first seaming and second seaming are performed in the same apparatus, a seaming cam for first seaming and a seaming cam for second seaming are formed integrally, and when first seaming and second seaming are performed in different apparatus, respective cams for first seaming and second seaming are used.

The seaming head rotary shaft 26 is rotary driven by a gear drive with a drive shaft 31 that is rotary driven via a drive pulley 30 that is driven by a motor (not shown in the figure). Likewise, the seaming cam shaft 28 is also rotary driven via the rotary shaft 31, but the gear ratios of the gear drive from the drive shaft 31 of the seaming head rotary shaft 26 and seaming cam shaft 28 are different, and the seaming cam shaft 28 is rotated at a rate slightly lower than that of the seaming head rotary shaft 26. In the model cam 25, as described hereinabove, a model cam groove 35 is formed for mating with a model cam follower 33 provided at a model cam lever having a seaming roller attached thereto via a seaming lever, and the cam surface of the model cam groove 35 is formed to have a shape corresponding to the seam shape of the can that will be seamed, so that the seaming roll moves along the can contour. In the conventional apparatus for seaming a square can, the first seaming roll and second seaming roll move along similar paths by revolving around the can. Therefore, by using the below-described respective model cam levers (and cam followers) for a first seaming roll and a second seaming roll, it is possible to perform control with one model cam. However, in the present embodiment, second seaming is performed along the path that swells slightly outwardly in the corner seamed portion. Therefore, a model cam follower 90 for first seaming and the model cam follower 33 for second seaming have different trajectories, and a special model cam for second seaming has to be provided. FIG. 8 shows the path of the cam groove 35 of the model cam 25 of the present embodiment. In the figure, a solid line shows a side wall 36-1 of the cam groove of the model cam for second seaming, and a virtual line shows a side wall 36-2 of the cam groove of the model cam for first seaming. The model cam for first seaming and model cam for second seaming, have a shape such that the paths in the linear portion match correspondingly to the seaming shape of the can, whereas in the corner seamed portion, the model cam for second seaming bulges outwardly by r in the central part of the corner.

Figure 6:
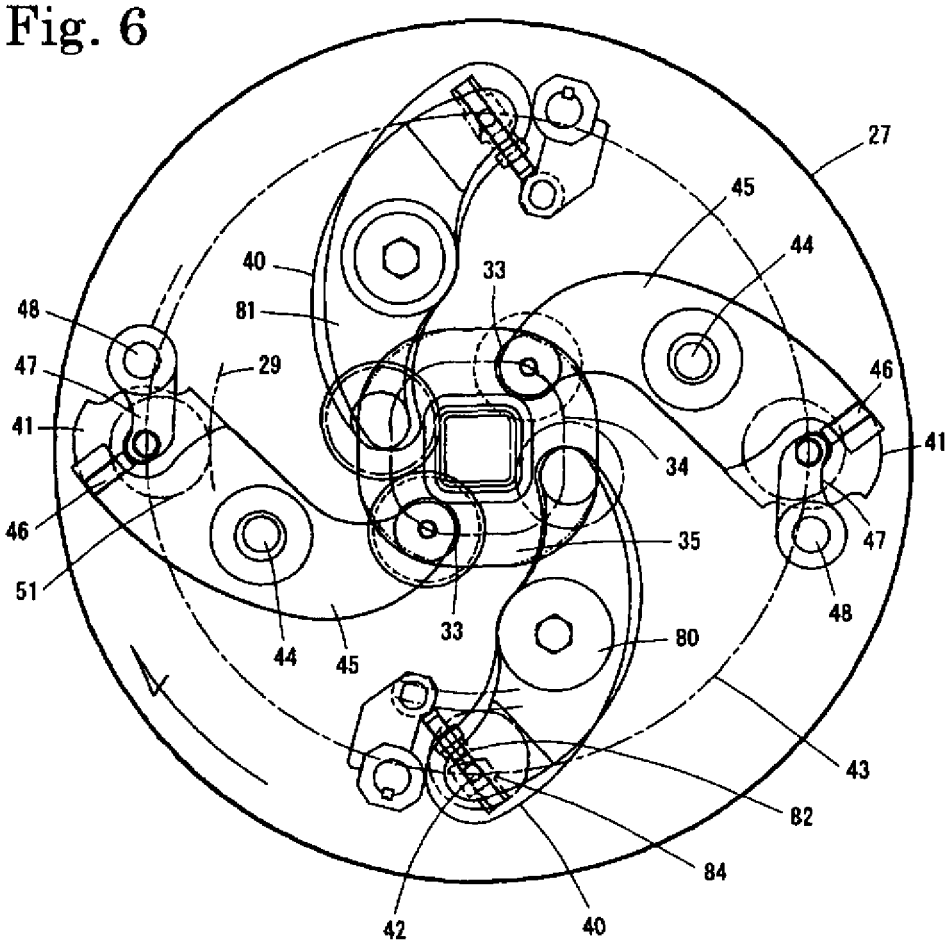
FIG. 6 is a view along the A-A arrow in FIG. 5.

FIG. 6 is a view along A-A in FIG. 5 where the seaming head unit 22 is shown from below. One end of the model cam lever is supported axially so that it can rotate at the seaming head rotary plate 27 that is rotary driven, and the seaming lever is so axially supported by a pin (in the figure, an eccentric pin that is preferred for fine adjustment of a seaming roll path) at the surface of the model cam lever that the seaming lever can swing. In the embodiment shown in the figures, two levers of each type are provided in symmetrical positions for first seaming and second seaming, and the levers for both the first seaming and the second seaming are shown in the figure. However, when apparatus for double seaming a square can are used as respective special apparatus for first seaming and second seaming, the model cam lever and seaming lever may be provided only for first seaming or second seaming. In the figure, the reference symbol 40 stands for a model cam lever for first seaming and 41 stands for a model cam lever for second seaming; the levers are axially supported so that they can swing about the shafts (not shown in the figure) that are provided vertically with a spacing of 90° on a circle 43 shown by a broken line in FIG. 6. A model cam follower that moves in a central track 34 of the model cam follower along the cam groove 35 of the model cam is axially and rotatably supported at the other end portion of the model cam lever; only the model cam follower 33 for second seaming is shown in the figure. Because first seaming is performed in the conventional manner, only second seaming will be explained below.

A seaming lever 45 is pivotally mounted on the lower surface (front surface in FIG. 6) of the model cam lever 41 for second seaming, so that the seaming lever can swing about an eccentric pin 44. A link lever 47 is joined via a link bolt 46 to the outer end portion of the seaming lever 45. The link lever 47 is fixed to a rotary shaft 48, and the rotary shaft is axially and rotatably supported by the seaming head rotary plate 27 and protrudes above the seaming head rotary plate. As shown in FIG. 5, a seaming cam lever 50 for second seaming protrudes at the upper end portion of the link lever, and a seaming cam follower 51 is axially and rotatably supported on the end portion of the seaming cam lever. Therefore, when the seaming cam lever 50 swings according to the cam shape of the seaming cam 29, the rotary shaft 48 rotates, the link lever 47 swings accordingly, the seaming lever 45 is caused to swing via the link bolt 46, the seaming roll provided at the other end of the seaming lever is displaced to face the seaming portion of the can body, and the predetermined seaming and molding are performed with controlled processing amount (push-in amount). Fine adjustment of the displacement amount (seaming processing amount) of the seaming roll can be performed by adjusting the length of the link bolt 46 and/or adjusting the rotation angle of the eccentric pin 44.

The eccentric pin 44 and link bolt 46 may be any parts or mechanisms that enable the swinging movement of the seaming lever 45, for example, mechanisms using a non-eccentric pin 80 or a second link lever 82 and a second rotary shaft 42 shown on the side of the model cam lever 40 for first seaming.

In accordance with the present invention, in the apparatus for double seaming a square can of the above-described configuration, the model cam for second seaming, second seaming roll, and seaming chuck are specially improved to obtain a square can with a small corner angle, small countersink depth, and high degree of sealing. Therefore, these components will be explained below in greater detail.

Figure 4:
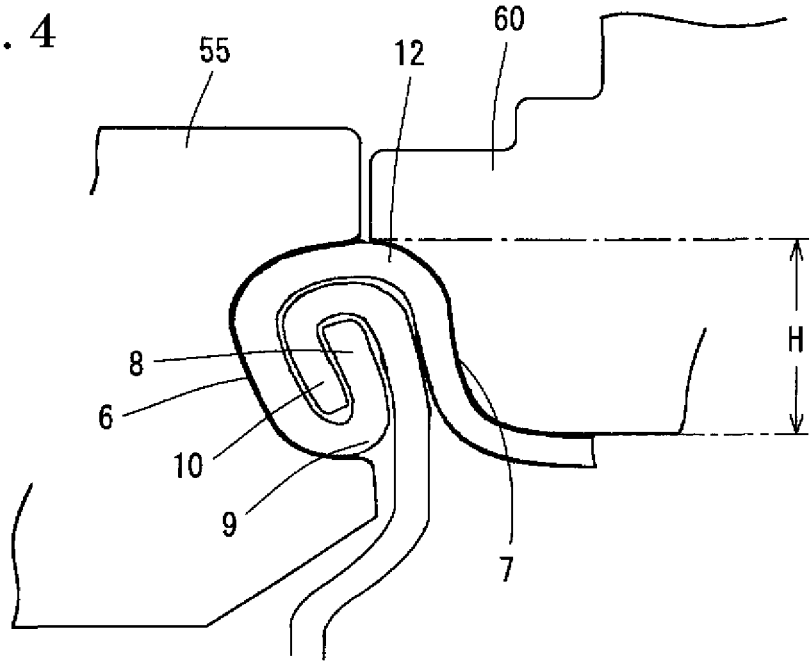
FIG. 4 is a schematic cross-sectional view illustrating main features of a second seaming roll and a seaming chuck upon completion of second seaming.
Figure 14:
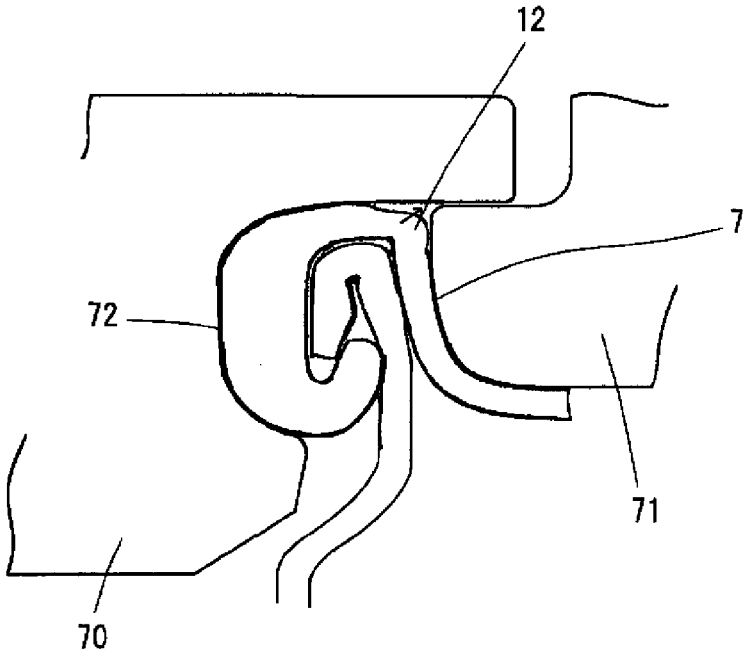
FIG. 14 is a schematic cross-sectional view illustrating the state of second seaming with a seaming apparatus of a comparative example.
Figure 15:
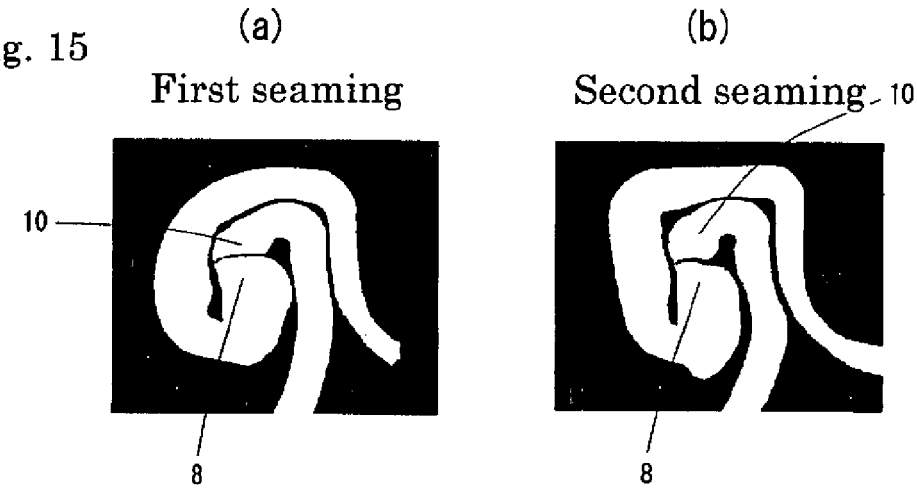
FIG. 15 is a microphotograph showing the cross-sectional shape of the corner seamed portion in the case where a square can with a decreased corner radius curvature is seamed with the conventional seaming apparatus and seaming wrinkles occur in first seaming; (a) is a cross-sectional view illustrating the state of first seaming; (b) is a cross-sectional view illustrating the state after second seaming.

FIG. 4 shows the cross-sectional shape of the main portions of the second seaming roll 55 and seaming chuck 60, this figure showing a state at a point in time in which second seaming is completed. In FIG. 7 an enlarged explanatory drawing of a groove 56 of the second seaming roll 55 is described in contradistinction to the conventional second seaming roll. The solid line represents the second seaming roll 55 of the present embodiment, and a virtual line represents a conventional second seaming roll 70. As described above, in the can body that is the object of the present invention, because the drawing ratio of the corner seamed portion is high, the increase in sheet thickness in the corner seamed portion is large and an engagement surface of the seaming chuck 6 with the chuck wall 7 is shallow. For these reasons, the overlap amount of cover hook and body hook during second seaming is small and the cover hook portion easily detaches from the body hook. To resolve this problem, the groove shape of the second seeming roll is improved so that the cover hook radius portion is pushed in obliquely upward during second seaming and a sufficient overlap amount of the cover hook and body hook is ensured. In the groove 56 of the second seaming roll of the present embodiment, a seaming wall formation surface 57 is inclined at an angle $\alpha$ such that the lower side thereof faces inward, a chin portion 58 is caused to protrude more than in the conventional second seaming roll, and a groove width w is reduced with respect to that in the conventional second seaming roll. Thus, the groove of the second seaming roll of the present embodiment and the groove of the conventional second seaming roll are such that the inclination angle $\alpha$ of the seaming wall formation surface is more than the inclination angle $\alpha'$ of the conventional seaming wall formation surface, and the groove width w of the present embodiment is less than a conventional groove width w'.

Where the second seaming roll 55 is formed in the above-described manner, if the second seaming roll 55 gradually pushes a portion that has been subjected to first seaming during second seaming, as shown in FIG. 4, the inclined seaming wall inclination surface can gradually cause inclination of the seaming wall of the can end, the chin portion 58 can push the cover hook radius portion 9 obliquely upward, and the cover hook 8 can be inserted in the back portion of the body hook 10. In this case, although the seaming chuck 60 is shallower than the conventional one and the backup amount is small, because a push-up force acts obliquely from below toward the seaming chuck, a sufficient backup is obtained and good seaming can be performed even though the chuck is shallower than in the conventional configuration. However, if the depth of the seaming chuck is simply less than that of the conventional seaming chuck, as shown in FIG. 14, a seaming panel radius portion 12 has no backup. Therefore, if the cover hook radius portion is pushed up obliquely from below by the second seaming roll, the seaming panel radius portion 12 escapes into a gap between the seaming chuck and second seaming roll and deforms and good seam shape cannot be obtained.

In order to resolve this problem in the present embodiment, as shown in FIG. 4, the seaming chuck 60 is formed in such a shape that the upper end portion of a surface that is in contact with the chuck wall is in contact with the seaming panel radius portion 12, and the seaming panel radius portion 12 is backed up by the seaming chuck. By forming the seaming chuck in such a shape, it is possible to conduct good seaming even of a can with a small countersink depth, without causing deformation of the seaming panel radius portion during second seaming.

In the above-described embodiment, a case is considered in which first seaming is conducted by the conventional method and only second seaming is improved. The above-described problem is, however, also encountered in seaming of square cans with a large curvature in first seaming by a conventional gradual seaming method, and it can be resolved by employing a technological means of seaming the linear seamed portion in the below-described manner.

Thus, in accordance with the present invention, the above-described problem can be resolved by a method for seaming a square can by which gradual molding is performed such that molding is completed by finally causing a seaming roll to follow the edge of a substantially square can with a model cam, wherein when a model cam follower is steered by a linear portion of the model cam at the initial stage of seaming, fluctuations of a push-in amount of a seaming roll during processing of the linear portion are maintained within a substantially constant range by changing an angle formed by a segment connecting a center of the model cam follower and a center of the seaming roll and a perpendicular to the linear portion of the model cam that steers the model cam follower from positive to negative or from negative to positive during seaming of the linear portion.

The seaming head of the apparatus for double seaming a square can of the present embodiment is configured as a whole as shown in the above-described FIG. 5, but here to facilitate understanding, only the configuration for performing first seaming will be explained with reference to schematic illustration in FIG. 9.

In the seaming head rotary plate 27 that is rotary driven, one end of the model cam lever 40 is supported axially so that it can swing about the model cam lever pin 80 as a fulcrum, and a first seaming lever 81 is supported axially so that it can swing via a seaming lever pin 82 (preferably, an eccentric pin such that enables fine adjustment of seam dimensions) on the surface of the model cam lever 40. The seaming lever pin 82 is pivotally supported so that it can swing at the intermediate portion of the first seaming lever 81, and a first seaming roll 83 that serves as a die for seaming and molding the square can is provided rotatably at the other end portion of the seaming lever 81. An opening angle adjustment mechanism is provided that comprises the first seaming lever 81, the seaming cam 29 (29-1) that controls an opening angle $\theta_1$ of the model cam lever 40, a seaming cam follower 85, a seaming cam operation lever 50 (50-1), and a seaming lever link 87. The opening angle can be also finely adjusted by using an eccentric pin that creates an eccentric rotary shaft for the seaming lever pin 82 as the opening angle adjustment mechanism and adjusting the angle of the eccentric pin. Likewise, the opening angle can be also finely adjusted by finely adjusting the length by using, for example, an extension rod of a joint system or screw system in the seaming lever link. In addition, the opening angle $\theta_1$ after setting can be also finely adjusted more accurately by using a combination of fine adjustment with the eccentric pin and sealing lever link.

In the present embodiment, in the above-described configuration, with consideration for sensitivity to the opening angle $\theta_1$ of first seaming lever 81 to the seaming force and input force of the seaming cam shaft 28, the seaming lever pin 82 is provided in an intermediate position of the model cam lever 40 for first seaming, and the distance from the center of the model cam lever pin 82 to the central point of the model cam follower is set equal to the distance from the center of the model cam lever pin 82 to the central point of the seaming roll. Furthermore, the model cam lever 40 and seaming lever 81 are set so as to be bent at the same angle from the intermediate portions thereof and so that the central position of the first seaming roll 83 and the model cam follower 88 are superimposed on the same central axis in the final position of seaming, thereby preventing the respective levers from interfering with the seaming chuck 71 as they rotate for seaming, and also facilitating the installation thereof in the apparatus.

One end of the model cam lever 40 is usually connected by the model cam lever pin 80 to the seaming head rotary plate 27, and can rotate about the model cam lever pin 80 as a center. By connecting the model cam follower 88 to the other end, the rotary moving force of the seaming head rotary plate 27 is converted into a square motion force along the substantially square model cam 90. Furthermore, the first seaming lever 81 that has an opening angle $\theta_1$ with the model cam lever 40 controlled by an opening angle adjustment mechanism is provided via the seaming lever pin 82 at the model cam lever 40 that has been converted to a square motion, the first seaming roll 83 is provided at one end of the first seaming lever 81, the value of opening angle $\theta_1$ is controlled by the seaming cam, the seaming molding amount is adjusted, the opening angle $\theta_1$ of the first seaming lever 81 is gradually decreased, eventually reaching 0 degree, and seaming is completed by rotating the seaming head 22 (first seaming roll 83) at least one time along the outer circumference of the square can.

As described above in the present seam embodiment, when the first seaming roll 83 passes the linear portion, the seaming roll gradually escapes outwardly and the same seaming width is not necessarily always obtained at the intermediate stage. In order to overcome this drawback, in the seaming process of the present embodiment, when the model cam follower 88 is steered along the linear portion of the model cam as the seaming process is started, fluctuations of a push-in amount of the seaming roll during linear portion processing are maintained within a substantially constant range by changing an angle formed by a segment connecting the center of the model cam follower and the center of the seaming roll and a perpendicular to the linear portion of model cam that steers the model cam follower from positive to negative or from negative to positive during seaming of the linear seamed portion. As shown below in greater detail, the configuration is such that the relationship between the angle $\omega$ through which the seaming head rotary plate rotates during linear portion molding and the angle $\theta$ formed by a segment connecting the model cam follower and the seaming roll and a line perpendicular to the linear portion of the model cam satisfies the following condition.

The present embodiment will be described below based on a modeled explanatory drawing shown in FIG. 11.

In FIG. 11, when the rotation center of the seaming head rotary plate is disposed on a perpendicular bisector of a linear potion A, A' of model cam trajectory, in the seaming roll at the initial stage of seaming, the angle formed by the segment AB connecting the model cam follower center A at the start part of the linear portion of the model cam and the seaming roll center B at this time and the perpendicular bisector of AA' is taken as θ (the direction to the left from the perpendicular bisector is taken as positive and that to the right is taken as negative). Where the angle formed by the segment A, B' connecting the model cam follower center A' at the end part of the linear portion of the model cam and the seaming roll center B' at this time and the perpendicular bisector of AA' after the seaming head base rotates through the angle ω (rotation to the right is taken as positive) is taken as θ' and the angle through which the seaming head rotary plate rotates as the model cam follower moves from the start part to the end part of the linear portion of the model cam is taken as ω the following condition is satisfied:

$$\theta'=\omega+\theta \quad (1)$$

This is because where the rotation center O of the seaming head rotary plate is located on the perpendicular bisector of the linear portion of the model cam, when the model cam follower moves along the linear portion AA' of the model cam, the angle ∠P'O'P through which the model cam lever PA rotates toward P'A' is equal to the opening angle ∠AOA' (=ω) of the linear portion AA' with respect to the rotation center O, as clearly follows from FIG. 11(*a*). Further, as shown in FIG. 11(*b*), when the segment connecting the seaming roll center B and model cam follower center A forms an angle θ with the perpendicular bisector of the linear portion of the model cam and the model cam lever PA rotates through an angle ω and moves toward P'A', if the angle formed by AB that rotated through an angle ω with the perpendicular bisector is taken as θ', then θ' becomes as follows: θ'=ω+θ.

Thus, as shown in FIG. 12, a perpendicular AA' passing through A is extended and the intersection thereof with PB is denoted by C. Where an additional line is drawn that passes through A' and is inclined to the positive side through the angle θ and intersection of this line with P'B' is denoted by C' and the intersection with a straight line AC is denoted by D, then ΔPAC≡ΔP'A'C'. Further, from ∠P'O'P=ω, it follows that the angle formed by the side P'A' and the side PA is ω. Therefore, ΔP'A'C' is obtained by rotating ΔPAC about O as a center through the angle ω. As a result, the angle formed by AC and A'C', that is, the angle formed by CD and C'D is ω. Therefore, the angle θ' formed by the segment AB connecting the seaming roll center B and the model cam follower center A with the segment connecting the seaming roll center B' and the model cam follower center A' relating to the point in time in which the model cam lever fulcrum P moved to P' and the model cam follower A moved to A' due to rotation of the seaming head rotary plate becomes ω−θ. Because the angle θ is set negative on the left side of the perpendicular bisector AA', θ' may be equal to ω+θ.

Therefore, where the seaming roll is disposed so that in Formula (1) above, when θ is negative and ω is positive:

$$\theta'=\omega+\theta>0 \quad (2),$$

and when θ is positive and ω is negative:

$$\theta'=\omega+\theta<0 \quad (3),$$

the angle formed by a segment connecting the model cam follower center and the seaming roll center and a perpendicular to the linear portion of model cam that steers the model cam follower in the course of steering the mold cam follower by the liner portion of the model cam when seaming is started will change from positive to negative or from negative to positive during seaming of the linear seamed portion, the monotonous variation of inclination angle $\theta_2$ of the segment between the rolls will be eliminated, the trajectory of the first seaming roll 83 will be prevented from shifting from the analogous trajectory of the model cam 90 at the initial stage of seaming processing, and it will be possible to obtain an almost uniform seaming width and prevent the occurrence of wrinkles. In the above-described model structure, the linear portion AA' of the model cam is determined by the shape of square can. Therefore, ω is determined almost uniquely. Where the arrangement of the seaming head rotary plate is determined in the above-described manner, the segment PA connecting the model cam lever pin P and the model cam follower center will be determined with a certain degree of freedom, while being somewhat restricted by the shapes of the seaming head rotary plate and square can. Therefore, once ω and A have been determined, the position of B can be determined freely as long as the conditions of Formula (2) and Formula (3) above are satisfied and the model cam lever 40 and first seaming lever 81 are within a range in which they do not interfere with the seaming chuck 71.

In this case, the condition $|\theta|=(1/2)|\omega|$ is ideal, but if the relationship $$(1/3)|\omega|\leq|\theta|\leq(2/3)|\omega| \quad (4)$$

is satisfied, it is suitable for practical use.

With the above-described configuration, the inclination angle of the segment connecting the first seaming roll center and the center of the model cam follower for first seaming is prevented from varying monotonously. Therefore, the distance between the seaming chuck 71 and the first seaming roll 83 has a point of inflection in the linear portion range and does not increase or decrease monotonously. As a result, the difference in distance from the seaming chuck 71 to the first seaming roll 83 between the two ends of the linear portion of the seaming chuck is eliminated, and excess processing in the vicinity of corner R portion is prevented. Further, because the difference in distance from the seaming chuck 71 to the first seaming roll between the two ends of the linear portion of the seaming chuck is greatly reduced, abrupt variation in the amount of processing in the corner portion is prevented, the occurrence of wrinkles is suppressed and good seaming can be performed even in the R portion with a large curvature, and a square can with high sealing ability can be obtained.

Example 1

In the apparatus of the above-described embodiment, the cam groove of the model cam for first seaming was formed to have a shape similar, with a predetermined scale ratio, to the outer periphery of the seaming chuck. In the cam groove for the model cam for second seaming, the linear portion was the same as in the model cam for first seaming, but the corner seamed portion was so formed as to produce a central trajectory along a circular arc passing through a position withdrawn outwardly through r=0.5 mm along the central line of the corner seamed portion in the cam groove of first seaming, as shown in FIG. 8. In the shape of the groove of the second seaming roll shown in FIG. 7, the settings were α=18° and w=3.4 mm. A seaming chuck having the shape shown in FIG. 4 was used, and the chuck depth was set to H=2.55 mm.

With the above-described apparatus, a can body (material A3003-H14, sheet thickness 0.5 mm) formed to have a curvature radius of 5 mm in the corner seamed portion and a can end (material A3004-H12, sheet thickness 0.5 mm) formed to have a curvature radius of 5 mm in the corner seamed portion of the chuck wall were subjected to double seaming to obtain a square can with a seaming width of the linear portion of 2.9 mm and a seaming width of the central part of the corner seamed portion of 3.4 mm as the target values. The cross section of the corner seamed portion of the can subjected to double seaming was observed under a scanning electron microscope to observe the seaming state. The cross section shape slightly differed depending on the can, but a typical example thereof is shown in FIG. 13(*a*).

As a comparative example, a cam with a cam groove shape identical to that of the above-described model cam for first seaming was used for the model cam for second seaming, and a roll with the groove shape shown by a virtual line in FIG. 7 and the settings of $\alpha$=6.5° and w=3.7 mm was used as the second seaming roll. The chuck depth in the seaming chuck was set to H=2.55 mm in the same manner as in the example, but the seaming chuck had a shape without a surface that comes into contact with the seaming panel radius portion, that is, as the conventional shape. With the apparatus for double seaming a square can that had such settings, double seaming was performed by employing the can end and can body in the same manner as in the example. Similarly to the example, a microphotograph of a representative example of the cross section of the corner seamed portion after completion of second seaming is shown in FIG. 13(*b*).

As for the seam shape in the double-seamed square can obtained in the example, the seaming width was 2.9 mm in the linear portion and 3.4 mm in the central zone of the corner seamed portion, that is, almost target values of seaming width were obtained. The curvature radius of the corner seamed portion of the chuck wall of the can end after seaming was 4.5 mm and the countersink depth was 2.8 mm. Therefore, a can with a much smaller seam size than that of the conventional square can was obtained. As for the cross-sectional shape of the seam, as shown by a microphotograph in FIG. 13(*a*), sufficient overlapping of the cover hook and body hook could be ensured, absolutely no cover hook separation was observed in the entire sample, and the entire can could be seamed effectively.

Figure 13:
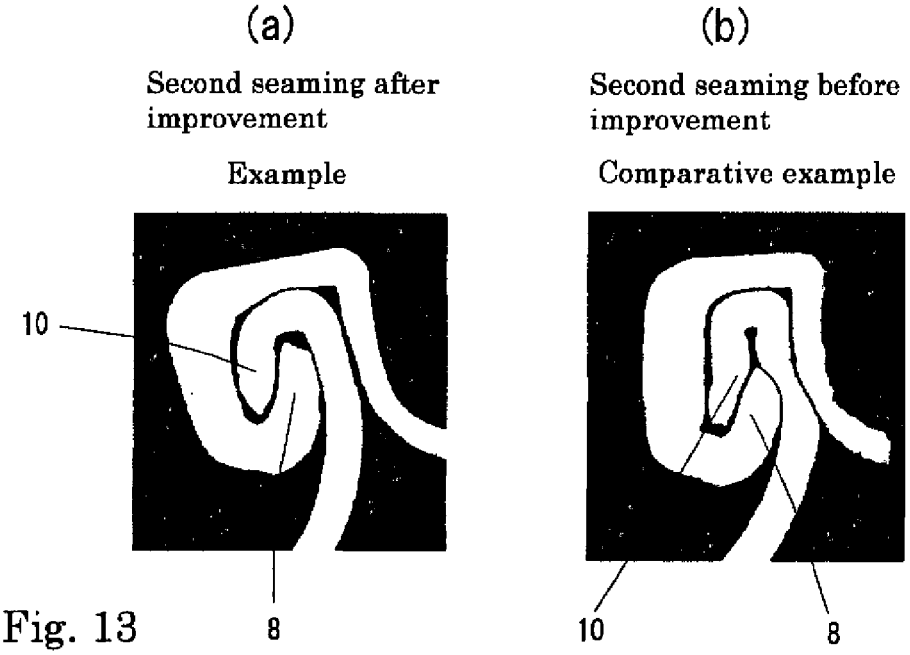
FIG. 13 is a microphotograph illustrating the cross-sectional shape of the corner seamed portion of a square can; (a) illustrates an embodiment of the present invention; (b) illustrates a comparative example.

By contrast, in the conventional example, as shown in FIG. 13(*b*), sufficient overlapping of the cover hook and body hook could not be attained, and the so-called drooping (cover hook separation) effect was observed in the entire can. Therefore, a risk of leak, in particular in the case of contents with a high internal pressure, is associated with the can of the comparative example, and such can is unsuitable for containers that require a high level of sealing.

Example 2

Figure 9:
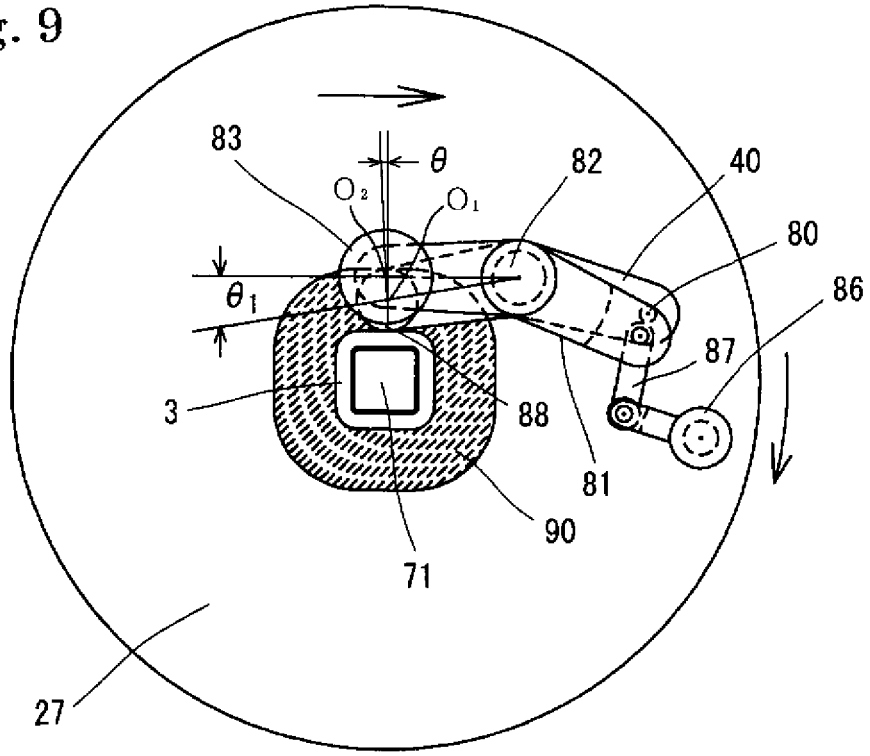
FIG. 9 is a schematic bottom view illustrating main features of a seaming head portion of an apparatus for double seaming a square can of another embodiment of the present invention.
Figure 10:
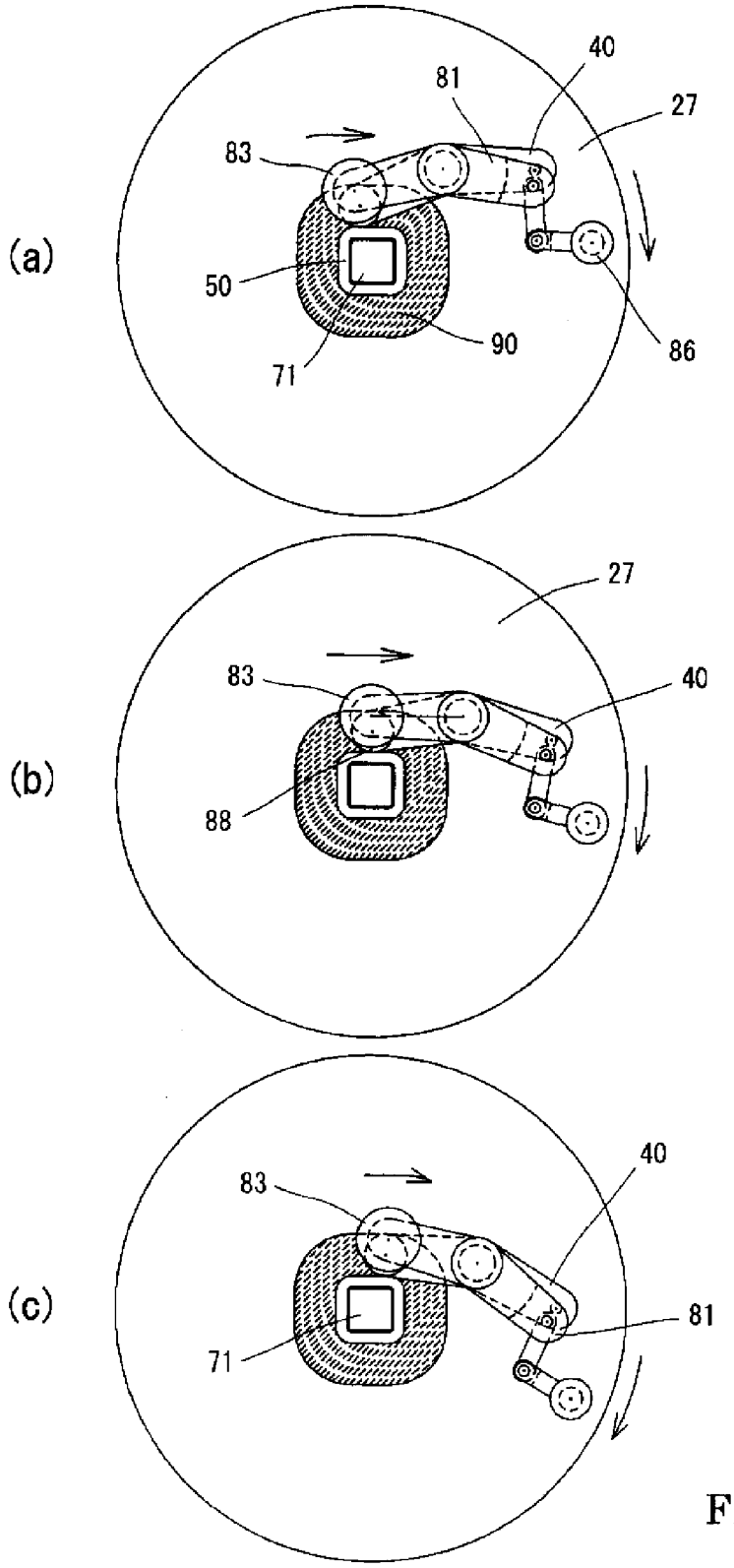
FIG. 10 is a bottom view illustrating the seaming advancement state of a linear portion.

A primary seamed square can was obtained by first seaming a substantially square lid 3 having the following dimensions in the seaming apparatus shown in FIGS. 5 and 9.

Lid contour prior to seaming: a substantially square shape with one side of 56 mm and a corner R of 8 mm.

Lid contour after first seaming: a substantially square shape with one side of the upper surface of 50 mm and a corner R of 5 mm; the seam thickness (T (TC) size) is 2 mm.

The outer dimensions of the double seaming apparatus of the present example that was used for seaming the square can was set as follows.

Seaming chuck: a substantially square shape with one side of 46 mm that is less than the outer shape contour by a seam thickness per one cycle and a corner R of 3 mm.

The seaming chuck is disposed in the center of the seaming head rotary plate.

Model cam for first seaming: a cam is formed with a width of 46 mm such that the center of cam follower describes a trajectory of an almost square shape with one side of 120 mm and a corner R40 of the can contour.

When the center of the model cam follower for first seaming was disposed on the left end of the linear portion, as shown in FIG. 13, an opening angle formed by a segment connecting the seaming chuck center and the model cam follower center and a segment connecting the seaming chuck center and the model cam follower center when the cam follower was disposed on the right side was 36.87°, and the angle formed by the segment with the central line in the y direction of the seaming chuck was 18.435°.

An apparatus where the model cam is to be installed places limitations thereon, but it is preferred that a substantially square shape be increased in size so as to enlarge the trajectory of the cam follower because the opening angle decreases and level of zigzagging in the trajectory of the seaming roll in the linear portion when the seaming is started is decreased.

As shown in FIG. 13, the seaming roll is disposed so that the angle formed by the segment connecting the seaming roll center and the model cam follower center with the central line in the y direction of the seaming chuck is 18.435°, which is half the opening angle 36.87°, and so that the molding surface of the seaming roll comes into contact with the outer circumference of the lid prior to seaming.

In the square can seam, the position of the pin serving as a fulcrum of the model cam lever and the seaming lever are determined by the apparatus in advance. Therefore, the model cam lever, seaming lever, and seaming lever link were appropriately designed with consideration for interference with the seaming chuck.

Figure 16:
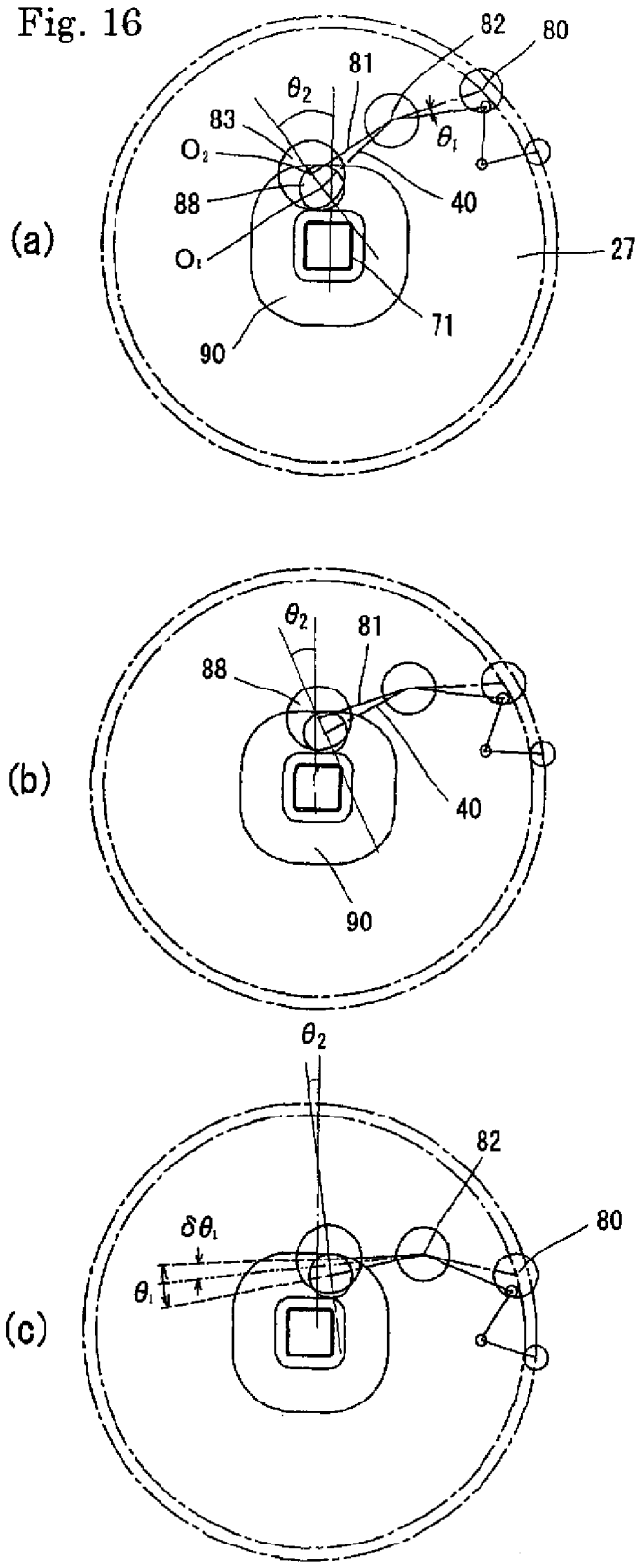
FIG. 16 is a schematic bottom view illustrating the seaming advancement state of a linear portion in seaming with the conventional square seaming apparatus.

The relationship between the advance of seeming in the tetragonal can that was seamed in the above-described manner and the variation of Tc size (seaming width in first seaming) was measured. As a comparative example, the variation of Tc size was measured in the conventional double-seaming apparatus shown in FIG. 16. The results are shown in FIG. 17.

Figure 17:
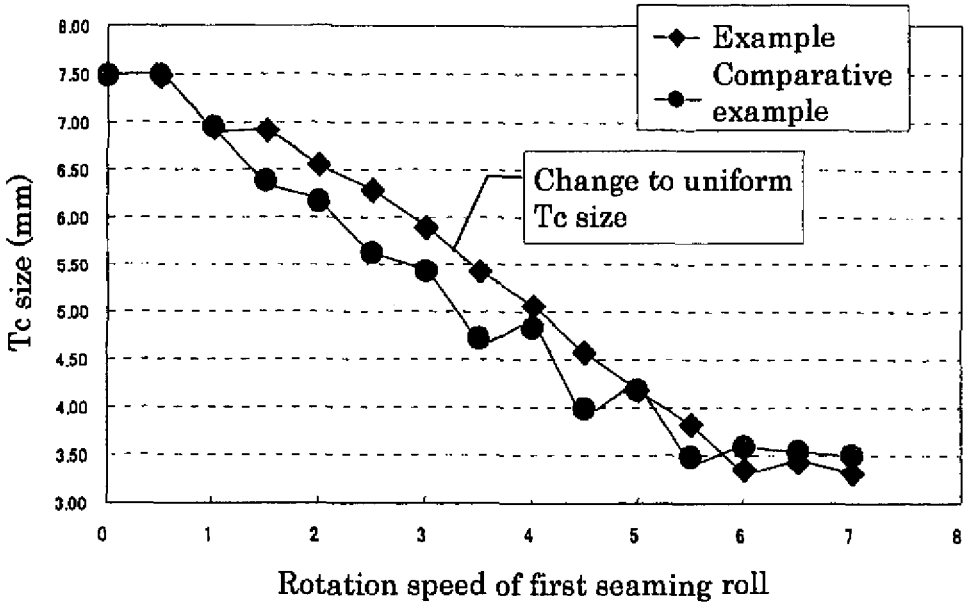
FIG. 17 is a graph shown the variation of Tc size during first seaming in an embodiment and a comparative example.

As shown in FIG. 17, in the relationship of the present example, the Tc size decreases uniformly and, as shown in the photo in FIG. 18(*a*), the balance of molding amount is good and the seam structure has an external appearance of a substantially square shape almost identical to the model cam shape. Although the corner R was small, few wrinkles occurred in the corner portion and a good seamed can was obtained. By contrast, in the comparative example, uniform Tc size was not obtained, the contour increased monotonously in one direction, and the contour had a shape somewhat rotated with respect to the seaming panel. Further, the occurrence of a large number of wrinkles was observed in the corner portion.

INDUSTRIAL APPLICABILITY

With the square can obtained in accordance with the present invention, seaming can be performed while maintaining a high sealing ability even in a square can with a large curvature of the corner seamed portion, and a square can with a very small curvature radius of the corner and a high degree of sealing can be obtained. Therefore, the square cans may be employed for filling and sealing food and beverages that require high sealing ability. Furthermore, because the can has a high accommodation efficiency and contents filling efficiency, it can be also used as a sealed container for various applications for example, capacitors (storage batteries) that require such characteristics.

The invention claimed is:

1. A rectangular can having a corner seamed portion and a linear seamed portion, comprising:

a can body; and a can end double seamed with said can body, the can end having a corner seamed portion and a linear seamed portion, wherein an outermost seaming wall of the corner seamed portion has a shape of a circular arc of a curvature radius less than the sum of a curvature radius of the chuck wall and a seeming width of a linear seamed portion, thereby the shape of said corner seamed portion swells outwardly and the seaming width of said corner seamed portion is greater than the seeming width of a linear seamed portion.

2. The rectangular can according to claim 1, wherein seaming walls of said linear seamed portion and said corner seamed portion have an obliquely inclined seam shape.

3. The rectangular can according to claim 2, wherein an inclination angle of said seaming wall is 15° to 21°.

4. The rectangular can according to claim 1, wherein a countersink depth of said can end is 2-4 mm.

5. The rectangular can according to claim 1, wherein a curvature radius of the corner seamed portion of said can body is 10 mm or less.

6. The rectangular can according to claim 1, wherein a degree of sealing is such that no leak occurs under a pressure of 0.3 MPa inside the can.

7. The rectangular can according to claim 1, wherein said rectangular can is a battery container.

* * * * *